US006583549B2

(12) United States Patent
Takenaka et al.

(10) Patent No.: US 6,583,549 B2
(45) Date of Patent: Jun. 24, 2003

(54) SPACER ASSEMBLY FOR FLAT PANEL DISPLAY APPARATUS, METHOD OF MANUFACTURING SPACER ASSEMBLY, METHOD OF MANUFACTURING FLAT PANEL DISPLAY APPARATUS, FLAT PANEL DISPLAY APPARATUS, AND MOLD USED IN MANUFACTURE OF SPACER ASSEMBLY

(75) Inventors: Shigeo Takenaka, Fukaya (JP); Kumio Fukuda, Fukaya (JP); Masaru Nikaido, Yokosuka (JP); Satoshi Ishikawa, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/990,345

(22) Filed: Nov. 23, 2001

(65) Prior Publication Data

US 2002/0036460 A1 Mar. 28, 2002

Related U.S. Application Data

(63) Continuation of application No. PCT/JP01/02367, filed on Mar. 23, 2001.

(30) Foreign Application Priority Data

| | | |
|---|---|---|
| Mar. 23, 2000 | (JP) | 2000-082849 |
| Mar. 23, 2000 | (JP) | 2000-082850 |
| Oct. 5, 2000 | (JP) | 2000-306458 |

(51) Int. Cl.[7] ..... H01J 1/96; H01J 1/304; H01J 9/24

(52) U.S. Cl. ..... 313/422; 313/495; 445/24

(58) Field of Search ..... 445/24; 313/495, 313/422

(56) References Cited

U.S. PATENT DOCUMENTS

| | | | | | |
|---|---|---|---|---|---|
| 5,413,513 | A | * | 5/1995 | Horne et al. | 445/24 |
| 5,667,418 | A | * | 9/1997 | Fahlen et al. | 445/25 |
| 5,704,820 | A | * | 1/1998 | Chandross et al. | 445/24 |
| 6,168,737 | B1 | * | 1/2001 | Poco et al. | 264/129 |

FOREIGN PATENT DOCUMENTS

| | | |
|---|---|---|
| EP | 0 982 756 | 3/2000 |
| EP | 1 061 546 | 12/2000 |
| JP | 01-137534 | 5/1989 |
| JP | 1-298629 | 12/1989 |
| JP | 2-299136 | 12/1990 |
| JP | 10-40837 | 2/1998 |
| JP | 10-125219 | 5/1998 |

* cited by examiner

*Primary Examiner*—Kenneth J. Ramsey
(74) *Attorney, Agent, or Firm*—Oblon, Spivak, McClelland, Maier & Neustadt, P.C.

(57) ABSTRACT

A spacer assembly has first and second spacers standing on first and second surfaces of a plate-like grid to be integral with them. First and second molds each with a plurality of through holes are arranged on the first and second surfaces of the grid to be in tight contact with them. After that, the through holes of the molds are filled with a glass paste containing an ultraviolet-curing binder, and the glass paste is cured by irradiation with ultraviolet rays. Furthermore, while the molds are held in a tight contact state, the glass paste is calcined at a predetermined temperature. Thus, the first and second spacers are integrally formed on the grid surfaces.

48 Claims, 10 Drawing Sheets

SPACER ASSEMBLY FOR FLAT PANEL DISPLAY APPARATUS, METHOD OF MANUFACTURING SPACER ASSEMBLY, METHOD OF MANUFACTURING FLAT PANEL DISPLAY APPARATUS, FLAT PANEL DISPLAY APPARATUS, AND MOLD USED IN MANUFACTURE OF SPACER ASSEMBLY

CROSS-REFERENCE TO RELATED APPLICATIONS

This is a Continuation Application of PCT application No. PCT/JP01/02367, filed Mar. 23, 2001, which was not published under PCT Article 21 (2) in English.

This application is based upon and claims the benefit of priority from the prior Japanese Patent Applications No. 2000-082849, filed Mar. 23, 2000, No. 2000-082850, filed Mar. 23, 2000, and No. 2000-306458, filed Oct. 5, 2000, the entire contents of all of which are incorporated herein by reference.

BACKGROUND OF THE INVENTION

1. Field of the Invention

The present invention relates to a spacer assembly used in a flat panel display apparatus, a method of manufacturing a spacer assembly, a flat panel display apparatus with a spacer assembly, a method of manufacturing a flat panel display apparatus, and a mold used in the manufacture of a spacer assembly.

2. Description of the Related Art

A flat panel display apparatus represented by a liquid crystal display apparatus has been widely used in various fields as a display apparatus that replaces a cathode ray tube (CRT).A liquid display apparatus, however, has several problems to be solved; for example, it does not emit light by itself and its display performance has view angle dependency.

In this situation, a self emission type flat panel display apparatus such as a field emission display (FED) or plasma display (PDP) is under development. For example, a surface conduction type electron-emitting display (SED) as one type of the FED has been intensively studied and developed because it can ensure good display characteristics compatible with those of a CRT.

This SED has a face plate and rear plate opposing each other at a predetermined gap. These plates are bonded to each other at their peripheries through a rectangular frame-like side wall, thus constituting a vacuum envelope. Three color phosphor layers are formed on the inner surface of the face plate, and a number of emitters corresponding to respective pixels are arranged on the inner surface of the rear plate to serve as electron-emitting sources for exciting phosphors. Each emitter is comprised of an electron-emitting portion, a pair of electrodes for applying a voltage to the electron-emitting portion, and the like.

A plate-like grid is disposed between the two plates. The grid has a number of apertures located to be aligned with the emitters, and a number of columnar spacers are arranged on the grid for maintaining the gap between the plates. An electron beam emitted from each emitter passes through the corresponding aperture of the grid and is converged on a desired phosphor layer.

As an FED having a spacer assembly comprised of a grid and spacers as described above, one disclosed in U.S. Pat. No. 5,846,205 is known. According to this FED, a plate-like grid has a number of spacer holes. A columnar spacer with a diameter slightly smaller than that of the spacer hole is inserted in each spacer hole, and is adhered and fixed to the grid with an adhesive frit glass, solder, or the like. Each spacer projects from the two surfaces of the grid, and its two ends abut against the inner surfaces of the face plate and rear plate, respectively.

As described above, when a spacer assembly is to be manufactured by inserting columnar spacers in a number of spacer holes formed in a grid and fixing them by using an adhesive or the like, the manufacture becomes very cumbersome, and it is difficult to improve the manufacturing efficiency. More specifically, each spacer is as very small as several 100 $\mu$m in diameter and several mm in height, and the spacer hole corresponding to it is also very small. To correctly insert such a very small spacer in the spacer hole of the grid and adhere it to the grid by using an adhesive or the like, high assembly precision is required. This makes the operation very difficult and leads to an increase in manufacturing cost and a decrease in manufacturing efficiency.

BRIEF SUMMARY OF THE INVENTION

The present invention has been made in view of the above situation, and has as its object to provide a spacer assembly for a flat panel display apparatus which can be manufactured easily, a flat panel display apparatus having a spacer assembly, a method of manufacturing a spacer assembly, a mold used in the manufacture of a spacer assembly, and a flat panel display apparatus which can prevent a decrease in display quality from being caused by charging of the spacer while a sufficiently high strength is ensured.

In order to achieve the above object, according to an aspect of the present invention, a method of manufacturing a spacer assembly having a substrate and a plurality of columnar spacers formed on the substrate and used for a flat panel display apparatus, comprises:

preparing a substrate and a mold with a number of through holes, arranging the mold on a surface of the substrate to be in tight contact therewith and filling the through holes of the mold with a spacer forming material, curing the spacer forming material by irradiation with radiation, thereby increasing adhesion of the spacer forming material with respect to the surface of the substrate to be higher than that of the spacer forming material with respect to the mold, calcining the spacer forming material with the mold being in tight contact with the substrate, thereby forming spacers on the substrate, and after cooling, releasing the mold from the substrate.

A method of manufacturing a spacer assembly according to another aspect of the present invention comprises preparing a substrate having opposing first and second surfaces and a plurality of through holes, and first and second molds each having a plurality of through holes, arranging the first and second molds on the first and second surfaces of the substrate to be in tight contact therewith such that the holes of the substrate and the through holes of the first and second molds are aligned with each other, and thereafter filling the through holes of the first and second mold with a spacer forming material, curing the spacer forming material by irradiation with radiation, thereby increasing adhesion of the spacer forming material with respect to the substrate to be higher than that of the spacer forming material with respect to the first and second molds, calcining the spacer forming material with the first and second molds being in tight contact with the substrate, thereby forming spacers on the first and second surfaces of the substrate, and after cooling, releasing the first and second molds from the substrate.

A method of manufacturing a spacer assembly according to another aspect of the present invention comprises:

preparing a substrate having opposing first and second surfaces, and first and second molds each having a plurality of through holes, arranging the first mold on the first surface of the substrate to be in tight contact therewith, and thereafter filling the through holes of the first mold with a spacer forming material, curing the spacer forming material by irradiation with radiation, thereby increasing adhesion of the spacer forming material with respect to the first surface of the substrate to be higher than that of the spacer forming material with respect to the first mold, arranging the second mold on the second surface of the substrate to be in tight contact therewith, and filling the through holes of the second mold with a spacer forming material, curing the spacer forming material by irradiation with radiation, thereby increasing adhesion of the spacer forming material with respect to the second surface of the substrate to be higher than that of the spacer forming material with respect to the second mold, after irradiation with the radiation, calcining the spacer forming material with the first and second molds being in tight contact with the substrate, thereby forming spacers on the first and second surfaces of the substrate, and after cooling, releasing the first and second molds from the substrate.

According to the manufacturing method described above, a glass paste containing at least an ultraviolet-curing binder and a glass filler is used as the spacer forming material, and in this case, the spacer forming material is cured by irradiation with ultraviolet rays as radiation.

As the substrate, a metal plate having a surface with an oxide film formed on it, a grid formed of a metal plate having a number of apertures and a surface with an oxide film formed on it, or a glass substrate can be used. As the mold, one subjected to surface treatment having releasability with respect to the spacer forming material and oxidation resistance is preferably used.

According to the method of manufacturing the spacer assembly with the above arrangement, a spacer forming material is calcined as it is arranged on a substrate or grid by using a mold, so a plurality of spacers can be built at predetermined positions on the substrate or grid at once. As a result, a spacer assembly with a plurality of small spacers can be manufactured easily, and the manufacturing cost can be reduced and the manufacturing efficiency can be improved.

The spacer forming material is calcined as it fills the through holes of the mold. Thus, during calcination, the spacer forming material will not be squeezed to spread, so spacers each with a sufficiently large height and high aspect ratio can be formed easily.

Furthermore, as the spacer forming material, a glass paste containing an ultraviolet-curing binder and a glass filler is used. Before calcination, the spacer forming material is cured by irradiation with ultraviolet rays, and a grid covered with an oxide film and a mold covered with an oxidation-resistant surface layer are used. Thus, adhesion of the spacer with respect to the substrate or grid can be increased to be higher than that with respect to the mold. As a result, in the following calcining and releasing steps, the formed spacers are prevented from attaching to the mold, so spacers integral with the substrate or grid can be formed reliably.

According to an aspect of the present invention, there is provided a method of manufacturing a flat panel display apparatus including a first substrate having an inner surface on which phosphor layers are formed, a second substrate arranged to oppose the first substrate at a predetermined gap and provided with phosphor exciting sources configured to excite the phosphor layers, a frame-like side wall that joins peripheries of the first and second substrates, a plate-like grid arranged between the first and second substrates to oppose the substrates and having a number of apertures located to correspond to the phosphor exciting sources, a number of columnar first spacers arranged between the first substrate and the grid, and a number of columnar second spacers arranged between the second substrate and the grid, the method comprising:

preparing a grid and a mold with a number of through holes, arranging the mold on a surface of the grid to be in tight contact therewith and filling the through holes of the mold with a spacer forming material, curing the spacer forming material by irradiation with radiation, thereby increasing adhesion of the spacer forming material with respect to the surface of the grid to be higher than that of the spacer forming material with respect to the mold, calcining the spacer forming material with the mold being in tight contact with the substrate, thereby forming the large number of first spacers on the grid, and after cooling, releasing the mold from the grid.

A flat panel display apparatus according to another aspect of the present invention comprises a first substrate having an inner surface with a phosphor layer formed thereon, a second substrate arranged to oppose the first substrate at a predetermined gap and provided with phosphor exciting sources configured to excite the phosphor layer, a frame-like side wall that joins peripheries of the first and second substrates, a plate-like grid arranged between the first and second substrates to oppose the substrates and having a number of apertures located to correspond to the phosphor exciting sources, a plurality of columnar first spacers arranged between the grid and the first substrate, and a plurality of columnar second spacers arranged between the grid and the second substrate, and wherein a height of each of the first spacers is larger than that of each of the second spacers.

In the flat panel display apparatus, the grid has a first surface opposing the first substrate and a second surface opposing the second substrate, and the first spacers vertically stand on the first surface of the grid to be integral therewith and the second spacers vertically stand on the second surface of the grid to be integral therewith.

A spacer assembly according to another aspect of the present invention comprises a substrate and a plurality of columnar spacers vertically standing on the substrate to be integral therewith. Each of the spacers integrally has a plurality of steps stacked from the substrate toward an extending end and with diameters that decrease gradually, and each of the steps is formed in a tapered shape to be thinner from the substrate toward the extending end.

A spacer assembly according to another aspect of the present invention comprises a plate-like grid having first and second opposing surfaces and a plurality of apertures, a plurality of columnar first spacers vertically standing on the first surface of the grid to be integral therewith, and a plurality of columnar second spacers vertically standing on the second surface of the grid to be integral therewith. Each of the first and second spacers integrally has a plurality of steps stacked from the grid toward an extending end and with diameters that decrease gradually, and each of the steps is formed in a tapered shape to be thinner toward an extending end.

A flat panel display apparatus according to another aspect of the present invention comprises a first substrate having an inner surface with a phosphor layer formed thereon, a second substrate arranged to oppose the first substrate at a predetermined gap and provided with phosphor exciting sources configured to excite the phosphor layer, a frame-like side wall that joins peripheries of the first and second substrates, and a spacer assembly formed between the first and second substrates. The spacer assembly has a plate-like grid having a number of apertures opposing the phosphor exciting sources, and a plurality of columnar spacers standing vertically on the grid to be integral therewith. Each spacer integrally has a plurality of steps stacked from the grid toward an extending end and with diameters that decrease gradually, and each step is formed in a tapered shape to be thinner toward the extending end.

According to the spacer assembly and flat panel display apparatus with the above arrangement, each spacer integrally has a plurality of steps stacked toward an extending end and with diameters that decrease gradually, and each step is formed in a tapered shape to be thinner toward the extending end, thus forming a stepped taper as a whole, i.e., a substantially stepped truncated conical shape. Therefore, a plurality of spacers can be integrally built on the substrate or grid with a mold or the like, and a spacer assembly and a flat panel display apparatus that can be manufactured easily can be obtained.

A method of manufacturing a spacer assembly according to another aspect of the present invention comprises preparing a substrate and a plate-like mold having a plurality of stepped tapered through holes each with a diameter that decreases gradually from one end toward the other end thereof, arranging the mold on a surface of the substrate to be in tight contact therewith such that large-diameter sides of the through holes are located on a substrate side and filling the through holes of the mold with a spacer forming material, curing the spacer forming material by irradiation with radiation, thereby increasing adhesion of the spacer forming material with respect to the surface of the substrate to be higher than that of the spacer forming material with respect to the mold, calcining the spacer forming material with the mold being in tight contact with the substrate, thereby integrally forming spacers on the substrate, and after cooling, releasing the mold from the substrate.

Another method of manufacturing a spacer assembly according to another aspect of the present invention comprises preparing a plate-like grid with first and second surfaces and a plurality of spacer holes located between the apertures, preparing plate-like first and second molds having a plurality of stepped tapered through holes each with a diameter that decreases gradually from one end toward the other end thereof, bringing the first and second molds into tight contact with the first and second surfaces of the grid such that large-diameter sides of the through holes are located on a grid side and arranging the first and second molds such that the spacer holes of the grid and the through holes of the first and second molds are aligned, and filling the through holes of the first and second molds with a spacer forming material, curing the spacer forming material by irradiation with radiation, thereby increasing adhesion of the spacer forming material with respect to the grid to be higher than that of the spacer forming material with respect to the first and second molds, calcining the spacer forming material with the first and second molds being in tight contact with the grid, thereby forming spacers on the first and second surfaces of the grid, and after cooling, releasing the first and second molds from the grid.

Still another method of manufacturing a spacer assembly according to an aspect of the present invention comprises preparing a plate-like grid having first and second surfaces, preparing plate-like first and second molds having a number of stepped tapered through holes each with a diameter that decreases gradually from one end toward the other end thereof, arranging the first mold on the first surface of the grid to be in tight contact therewith such that large-diameter sides of the through holes are located on a grid side, and filling the through holes of the first mold with a spacer forming material, curing the spacer forming material by irradiation with radiation, thereby increasing adhesion of the spacer forming material with respect to the first surface of the grid to be higher than that of the spacer forming material with respect to the first mold, arranging the second mold on the second surface of the grid to be in tight contact therewith such that large-diameter sides of the through holes are located on a grid side, and filling the through holes of the second mold with a spacer forming material, curing the spacer forming material by irradiation with radiation, thereby increasing adhesion of the spacer forming material with respect to the second surface of the grid to be higher than that of the spacer forming material with respect to the second mold, after irradiation with the radiation, calcining the spacer forming material with the first and second molds being in tight contact with the grid, thereby forming spacers on the first and second surfaces of the grid, and after cooling, releasing the first and second molds from the substrate.

According to an aspect of the present invention, in the above manufacturing method, a glass paste containing an ultraviolet-curing binder and a glass filler is used as the spacer forming material In this case, the spacer forming material is cured by irradiation with ultraviolet rays as the radiation. As the substrate, a metal plate with a surface formed with an oxide film, a grid formed of a metal plate having a number of apertures and a surface formed with an oxide film, or a glass substrate can be used.

According to the spacer assembly manufacturing method with the above arrangement, a spacer forming material is calcined as it is arranged on a substrate or grid by using a mold, so a plurality of spacers can be built at predetermined positions on the substrate or grid at once. As a result, a spacer assembly with a plurality of small spacers can be manufactured easily, and the manufacturing cost can be reduced and the manufacturing efficiency can be improved.

The spacer forming material is calcined as it fills the through holes of the mold. Thus, during calcination, the spacer forming material will not be squeezed to spread, so spacers each with a sufficiently large height and high aspect ratio can be formed easily.

Furthermore, as the spacer forming material, a glass paste containing at least an ultraviolet-curing binder and a glass filler is used. Before calcination, the spacer forming material is cured by irradiation with ultraviolet rays, and a grid covered with an oxide film and a mold covered with an oxidation-resistant surface layer are used. Thus, adhesion of the spacer with respect to the substrate or grid can be increased to be higher than that with respect to the mold. As a result, in the following calcining and releasing steps, the formed spacers are prevented from attaching to the mold, so spacers integral with the substrate or grid can be formed reliably.

A mold used in the manufacture of a spacer assembly according to an aspect of the present invention comprises a plurality of metal thin plates each having a plurality of tapered through holes, each of the through holes of each of the metal thin plates has a diameter different from those of through holes of other metal thin plates, and the plurality of metal thin plates are stacked such that their through holes are aligned with each other and such that the through holes sequentially line up in descending order of diameter.

With the above arrangement, the mold is formed by stacking a plurality of metal thin plate each with through holes, and each through hole of the mold is defined by overlaying a plurality of through holes. In the case of a metal thin plate, small through holes can be formed comparatively easily by etching, laser irradiation, or the like. Therefore, when these plurality of metal thin plates are stacked, a mold having through holes with desired heights can be obtained easily.

In the above mold, the through holes formed in each metal thin plate are tapered, and their diameters differ from one metal thin plate to another. When these plurality of metal thin plates are to be stacked, even if some misalignment occurs, the through holes of the metal thin plates are caused to reliably communicate with each other, and a mold with desired through holes can be obtained.

Furthermore, according to an aspect of the present invention, the mold is covered with a surface layer having releasability with respect to the spacer forming material. Hence, the spacer forming material does not easily attach to the inner portions of the through holes of the mold, and the mold can be repeatedly used for the manufacture of a spacer assembly.

A flat panel display apparatus according to another aspect of the present invention comprises a face plate and a rear plate arranged to oppose each other at a predetermined gap, and a spacer assembly disposed between the face plate and the rear plate, wherein the spacer assembly has an electrode plate having opposing first and second surfaces and a plurality of spacer holes and arranged between the face plate and the rear plate to oppose the face plate and the rear plate, a plurality of first spacers formed on the first surface of the electrode plate, a plurality of second spacers formed on the second surface of the electrode plate, and a connecting portion connecting one of the second spacers to a plurality of first spacers to each other through corresponding spacer holes formed in the electrode plate.

Another flat panel display apparatus according to an aspect of the present invention comprises a face plate with an inner surface with a phosphor layer formed thereon, a rear plate arranged to oppose the face plate at a predetermined gap and provided with a plurality of electron-emitting portions for exciting the phosphor layer, a frame-like side wall that joins peripheries of the face plate and the rear plate, and a spacer assembly formed between the face plate and the rear plate.

The spacer assembly has an electrode plate having opposing first and second surfaces and a plurality of spacer holes and arranged between the face plate and the rear plate to oppose the face plate and the rear plate, a plurality of first spacers formed on the first surface of the electrode plate and in contact with the face plate, and a plurality of second spacers formed on the second surface of the electrode plate and in contact with the rear plate. One of the second spacers is connected to a plurality of first spacers to each other with a connecting portion through corresponding spacer holes formed in the electrode plate.

According to the flat panel display apparatus with the above arrangement, the spacer assembly has a plurality of first spacers formed on a first surface of the electrode plate and a plurality of second spacers formed on a second surface of the electrode plate. One second spacer is arranged to be connected to a plurality of first spacers to each other through a connecting portion. Therefore, a sufficiently high structural strength can be ensured for the spacer assembly, and a sufficiently large aspect ratio can be ensured for the first spacers, so the adverse influence of charging of the first spacers can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

Embodiments in which the present invention is applied to a surface conduction type electron-emitting apparatus (to be referred to as an SED hereinafter) as a flat panel display apparatus will be described in detail.

Figure 1:
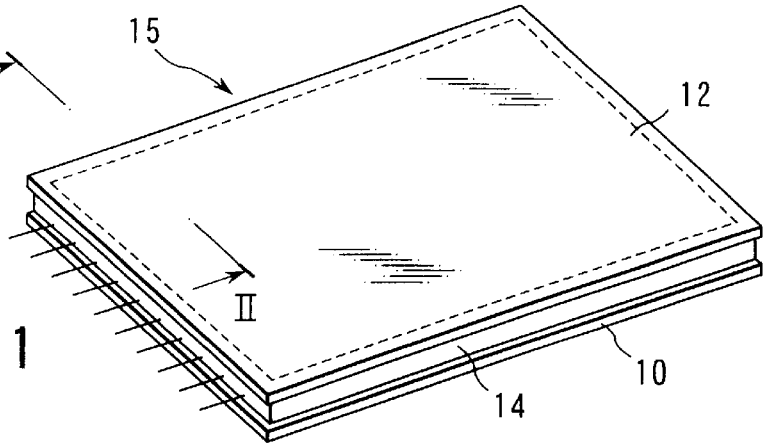
FIG. 1 is a perspective view showing a surface conduction type electron-emitting apparatus according to an embodiment of the present invention.
Figure 2:
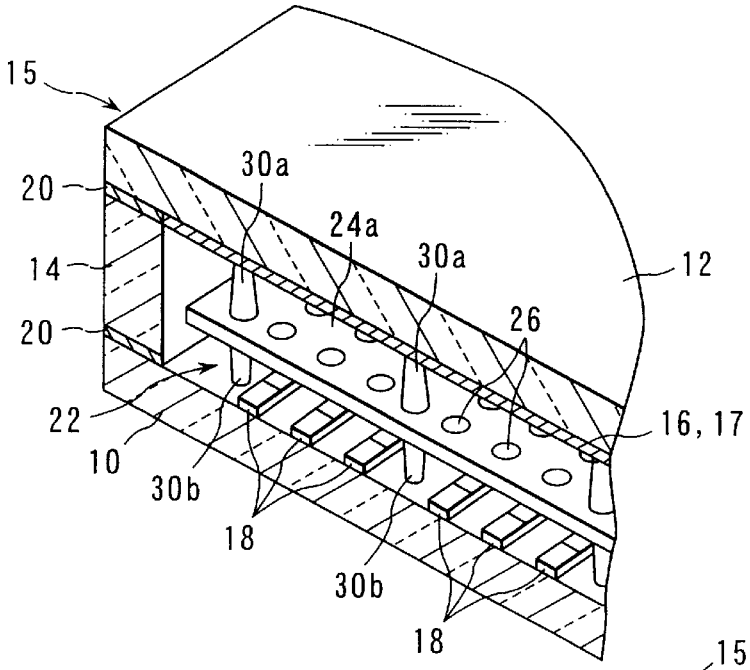
FIG. 2 is a perspective view of the surface conduction type electron-emitting apparatus taken along the line II—II of FIG. 1.
Figure 3:
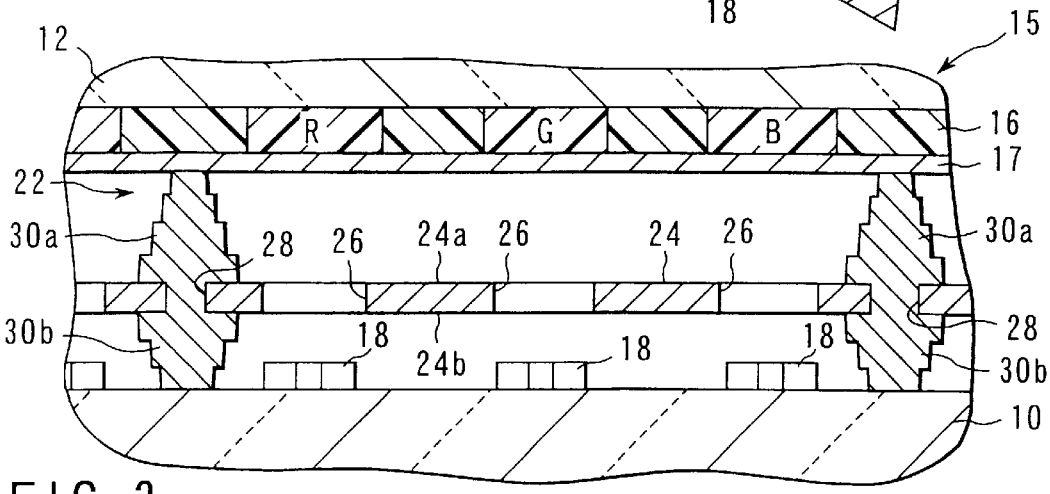
FIG. 3 is an enlarged sectional view of the surface conduction type electron-emitting apparatus.

As shown in FIGS. 1 to 3, this SED has a rear plate 10 and face plate 12 respectively formed of a rectangular glass members. These plates are arranged to oppose each other at a gap of about 1.5 mm to 3.0 mm. The rear plate 10 is formed with a size slightly larger than that of the face plate 12. The rear plate 10 and face plate 12 are joined at their peripheries through a rectangular frame-like side wall 14 made of glass, thus constituting a flat rectangular vacuum envelope 15. The side wall 14 is adhered with frit glass, a low-melting metal or alloy such as indium or indium alloy. For example, the internal space of the vacuum envelope is maintained at a high vacuum of about $10^{-8}$ Torr.

A phosphor screen 16 is formed on the inner surface of the face plate 12. The phosphor screen 16 is formed by lining red, blue, and green phosphor layers and black-colored layers. These phosphor layers are formed in stripes or dots. A metal back 17 made of aluminum or the like is formed on the phosphor screen 16. A transparent conductive film made of, e.g., ITO, or a color film may be arranged between the face plate 12 and the phosphor screen.

A number of electron-emitting elements 18 for respectively emitting electron beams are formed on the inner surface of the rear plate 10 to serve electron-emitting sources for exciting the phosphor layers. The electron-emitting elements 18 are arranged in a plurality of columns and a plurality of rows to correspond to respective pixels. Each electron-emitting element 18 is comprised of an electron-emitting portion (not shown), a pair of element electrodes for applying a voltage to the electron-emitting portion, and the like. A number of interconnections (not shown) for applying a voltage to the electron-emitting elements 18 are formed on the rear plate 10 in a matrix.

The side wall 14 serving as the joining member is adhered to the peripheries of the rear plate 10 and frit glass 20 through frit glass 20 made of, e.g., low-melting glass, to join the face plate and rear plate to each other.

As shown in FIGS. 2 and 3, the SED has a spacer assembly 22 arranged between the rear plate 10 and face plate 12. In this embodiment, the spacer assembly 22 has a plate-like grid 24 and a plurality of columnar spacers standing on the two surfaces of the grid to be integral with them.

More specifically, the grid 24 has a first surface 24*a* opposing the inner surface of the face plate 12, and a second surface 24*b* opposing the inner surface of the rear plate 10, and is arranged parallel to these plates. A number of apertures 26 and a plurality of spacer holes 28 are formed in the grid 24 by etching or the like. The apertures 26 are disposed to oppose the electron-emitting elements 18, and the spacer holes 28 are located between the apertures and disposed at a predetermined pitch.

The grid 24 is formed from a metal plate of, e.g., an iron-nickel-based metal, to a thickness of 0.1 mm to 0.25 mm, and an oxide film made of elements constituting the metal plate, e.g., an oxide film made of $Fe_3O_4$ or $NiFe_3O_4$, is formed on its surface. Each aperture 26 has a rectangular shape of 0.15 mm to 0.25 mm×0.20 mm to 0.40 mm, and each spacer hole 28 has a diameter of about 100 $\mu$m to 200 $\mu$m.

First spacers 30*a* integrally stand on the first surface 24*a* of the grid 24 to overlap the respective spacer holes 28, and their extending ends abut against the inner surface of the face plate 12 through the metal back 17 and the black-colored layers of the phosphor screen 16. Second spacers 30*b* integrally stand on the second surface 24*b* of the grid 24 to overlap the respective spacer holes 28, and their extending ends abut against the inner surface of the rear plate 10. The spacer holes 28 and the first and second spacers 30*a* and 30*b* are aligned with each other, and the first and second spacers are integrally connected to each other through the corresponding spacer holes 28.

Each of the first and second spacers 30*a* and 30*b* integrally has a plurality of steps stacked from the grid 24 toward the extending end and with gradually decreasing diameters. Each step is formed in a tapered manner to be thinner from the grid toward the extending end. In other words, each of the first and second spacers 30*a* and 30*b* is formed into a stepped tapered shape or stepped truncated-conical shape.

For example, each first spacer 30*a* forms a stepped tapered shape with four steps such that its end on the grid 24 side has a diameter of about 400 $\mu$m, its end on the extending end side has a diameter of about 230 $\mu$m, and its height is about 1 mm to 1.2 mm, resulting in an aspect ratio (height/grid-side end diameter) of 2.5 to 3.0. Each second spacer 30*b* forms a stepped tapered shape with three steps such that its end on the grid 24 side has a diameter of about 400 $\mu$m, its end on the extending end side has a diameter of about 280 $\mu$m, and its height is about 0.3 mm to 0.75 mm, resulting in an aspect ratio (height/grid-side end diameter) of 0.75 to 1.6.

As described above, the diameter of each spacer hole 28 is about 100 $\mu$m to 200 $\mu$m, which is sufficiently smaller than the grid-side end diameters of the first and second spacers 30*a* and 30*b*. When the first and second spacers 30*a* and 30*b* are integrally formed to be coaxially aligned with the spacer holes 28, the first and second spacers are connected to each other through the spacer holes, and are integrally formed with the grid 24 to sandwich it from its two surfaces.

A predetermined voltage is applied from a power supply (not shown) to the grid 24 of the spacer assembly 22 with the arrangement as described above so as to prevent crosstalk, and to converge the electron beams emitted from the corresponding electron-emitting elements 18 onto desired phosphor layers with the apertures 26. The first and second spacers 30*a* and 30*b* abut against the inner surfaces of the face plate 12 and rear plate 10 to support the load of the atmospheric pressure acting on these plates, and maintain the gap between the plates at a predetermined value.

A method of manufacturing the spacer assembly 22 with the above arrangement, and the SED with the spacer assembly 22 will be described.

Figure 4:
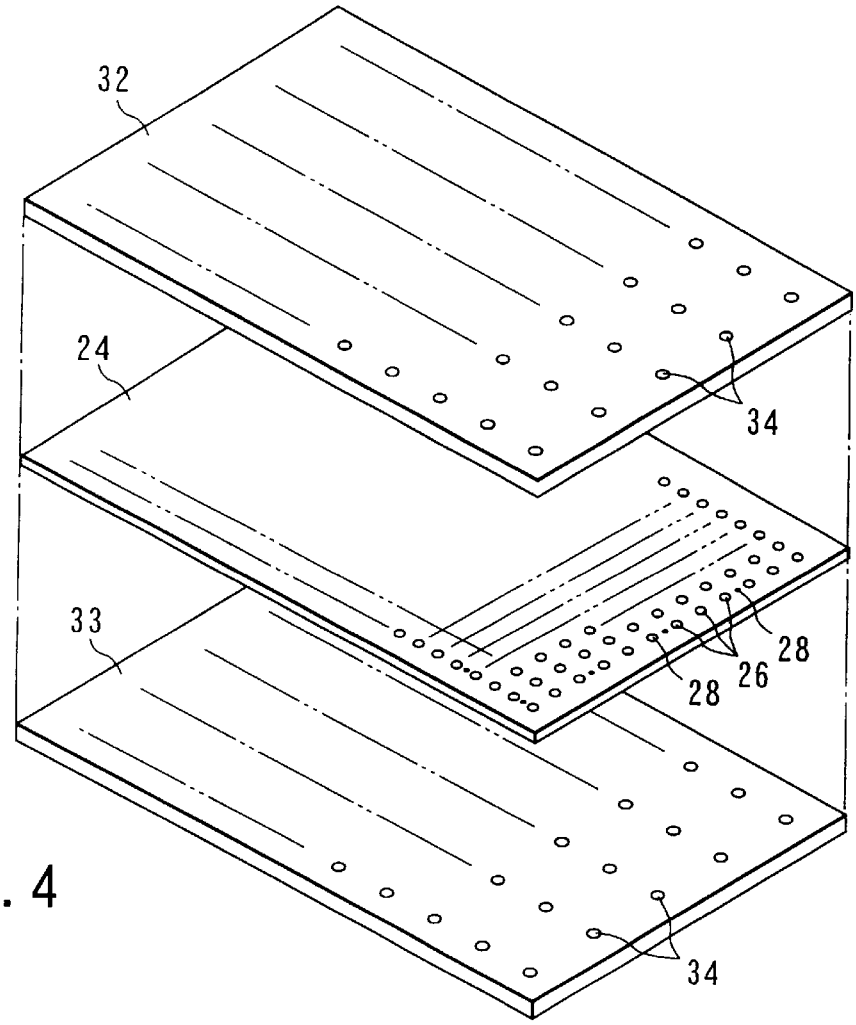
FIG. 4 is an exploded perspective view showing a grid and first and second molds used in the manufacture of a spacer assembly in the surface conduction type electron-emitting apparatus.

When the spacer assembly 22 is to be manufactured, first, as shown in FIG. 4, the grid 24 with a predetermined size, and rectangular plate-like first and second molds 32 and 33 with sizes almost equal to that of the grid are prepared. Apertures 26 and spacer holes 28 are formed in the grid 24 in advance, and the entire outer surface of the grid 24 is covered with a blackened film or an oxide film made of granular oxides.

Figure 5:
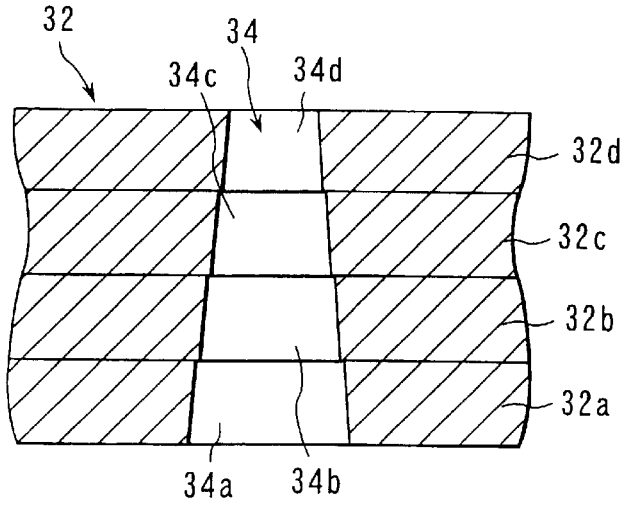
FIG. 5 is an enlarged sectional view of part of the first mold.

The first and second molds 32 and 33 have a plurality of through holes 34 corresponding to the spacer holes 28 of the grid 24. As shown in FIG. 5, the first mold 32 is formed by stacking a plurality of metal thin plates, e.g., 4 metal thin plates 32*a*, 32*b*, 32*c*, and 32*d*.

This will be described in detail. Each metal thin plate is formed of an iron-based metal plate with a thickness of 0.25 mm to 0.3 mm, and has a plurality of tapered through holes. The through holes formed in each of the metal thin plates 32*a*, 32*b*, 32*c*, and 32*d* have diameters different from those of the through holes formed in other metal thin plates. For example, the metal thin plate 32*a* has tapered through holes 34*a* with a maximum diameter of 400 μm, the metal thin plate 32*b* has tapered through holes 34*b* with a maximum diameter of 350 μm, the metal thin plate 32*c* has tapered through holes 34*c* with a maximum diameter of 295 μm, and the metal thin plate 32*d* has tapered through holes 34*d* with a maximum diameter of 240 μm. These through holes 34*a* to 34*d* are formed by etching or laser radiation.

The four metal thin plates 32*a*, 32*b*, 32*c*, and 32*d* are stacked such that their through holes 34*a*, 34*b*, 34*c*, and 34*d* are aligned almost coaxially and sequentially from the ones with larger diameters, and are diffusion-bonded to each other in vacuum or a reducing atmosphere. Hence, the first mold 32 with a thickness of 1.0 mm to 1.2 mm as a whole is formed. Each through hole 34 is defined by aligning the four through holes 34*a*, 34*b*, 34*c*, and 34*d*, and has a stepped, tapered inner surface.

The second mold 33 is also formed by stacking, e.g., three metal thin plates in the same manner as the first mold 32. Each through hole 34 is defined by three tapered through holes and has a stepped, tapered inner surface.

The outer surfaces of the first and second molds 32 and 33, including the inner surfaces of the respective through holes 34, are covered with surface layers. Each surface layer has releasability with respect to a spacer forming material (to be described later) and resistance to oxygen, and is formed by, e.g., eutectic plating of Ni—P with fine particles of Teflon, oxide, nitride, or carbide, or eutectic plating of Ni—P with a high-melting metal such as W, Mo, or Re.

Figure 6A:
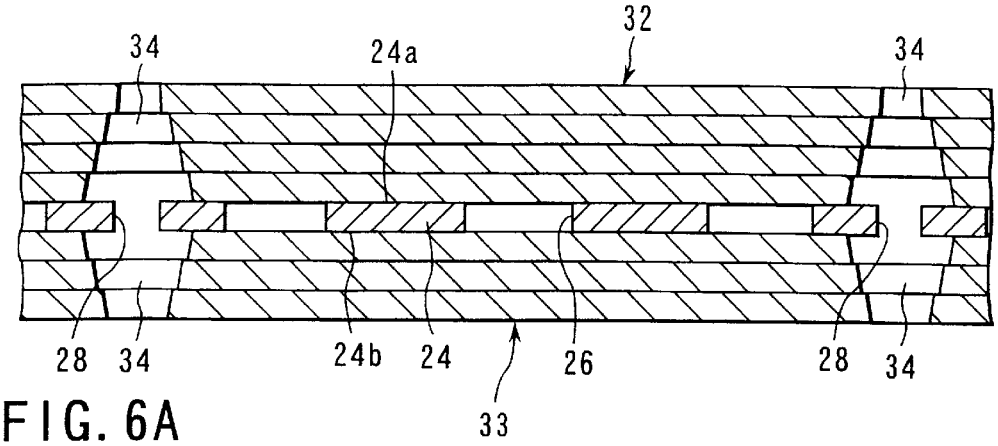
FIGS. 6A to 6C are sectional views respectively showing the steps in manufacturing the spacer assembly.

In the steps of manufacturing the spacer assembly, as shown in FIG. 6A, the first mold 32 is brought into tight contact with the first surface 24*a* of the grid so the large-diameter sides of the through holes 34 are located on the grid 24 side, and is positioned such that the through holes are aligned with the spacer holes 28 of the grid. Similarly, the second mold 33 is brought into tight contact with the second surface 24*b* of the grid so the large-diameter sides of the through holes 34 are located on the grid 24 side, and is positioned such that the through holes are aligned with the spacer holes 28 of the grid. The first mold 32, grid 24, and second mold 33 are fixed to each other by using a damper (not shown) or the like.

Figure 6B:
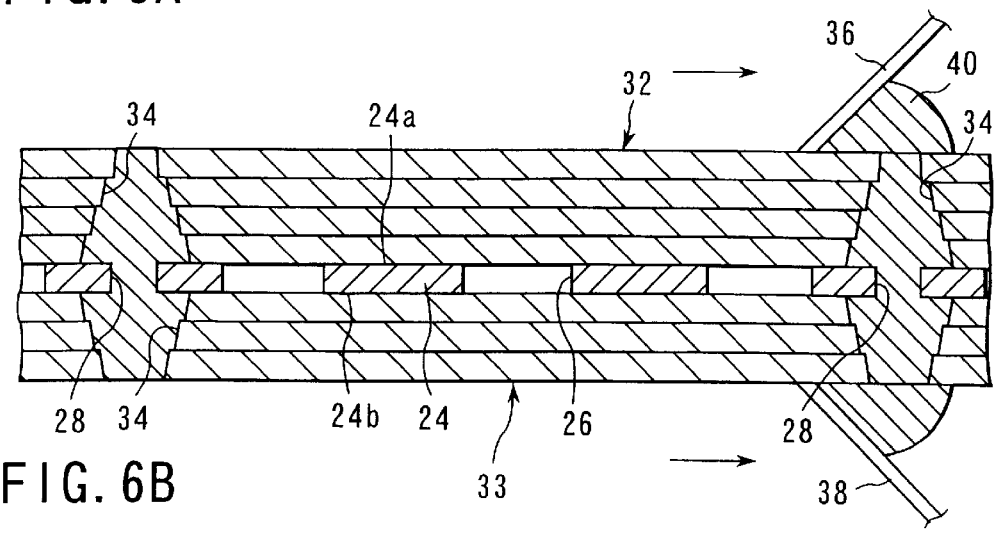

Subsequently, as shown in FIG. 6B, a spacer forming material 40 in the form of paste is supplied from, e.g., the outer surface of the first mold 32, by using a squeegee 36, to fill the through holes 34 of the first mold 32, the spacer holes 28 of the grid 24, and the through holes 34 of the second mold 33. An excessive portion of the spacer forming agent 40 leaking to the outer surface of the second mold 33 is scraped off by using a squeegee 38.

As the spacer forming material 40, a glass paste containing at least an ultraviolet-curing binder (organic component) and a glass filler is used.

Figure 6C:
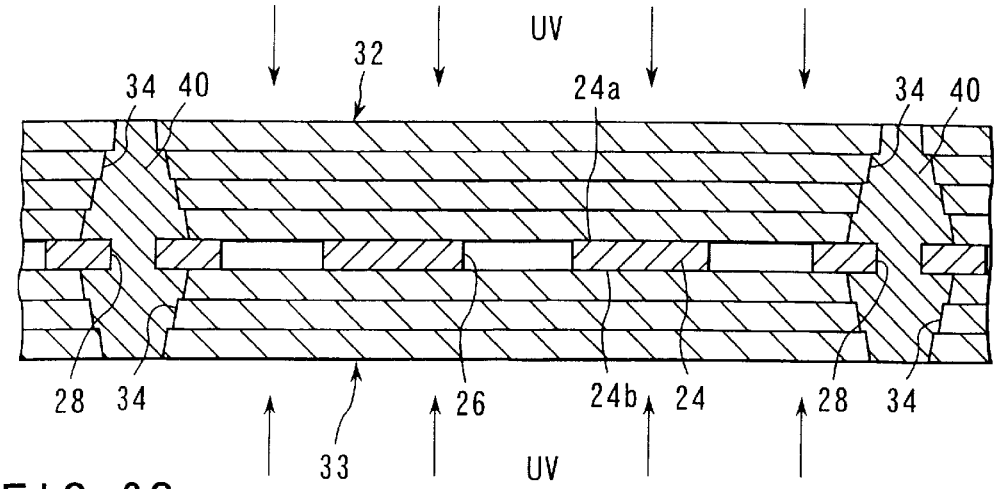

Subsequently, as shown in FIG. 6C, the filling spacer forming material 40 is irradiated with ultraviolet rays (UV) as a radiation from the outer surfaces of the first and second molds 32 and 33, so it is UV-cured. When the spacer forming material 40 is UV-cured in this manner, adhesion of the spacer forming material with respect to the grid 24 is increased to be higher than that of the spacer forming material with respect to the first and second molds 32 and 33.

Figure 7A:
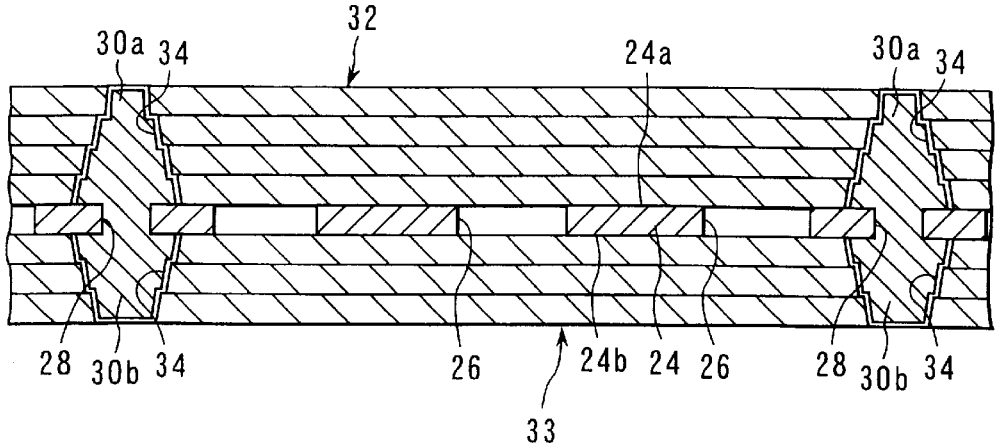
FIGS. 7A and 7B are sectional views respectively showing the steps in manufacturing the spacer assembly.

As shown in FIG. 7A, while the first and second molds 32 and 33 are in tight contact with the grid 24, they are heat-treated in a heating furnace to evaporate the binder from the spacer forming material 40, and then the spacer forming material is properly calcined at about 500° C. to 550° C. for 30 minutes to 1 hour. Hence, the first and second spacers 30*a* and 30*b* integral with the grid 24 are formed.

Figure 7B:
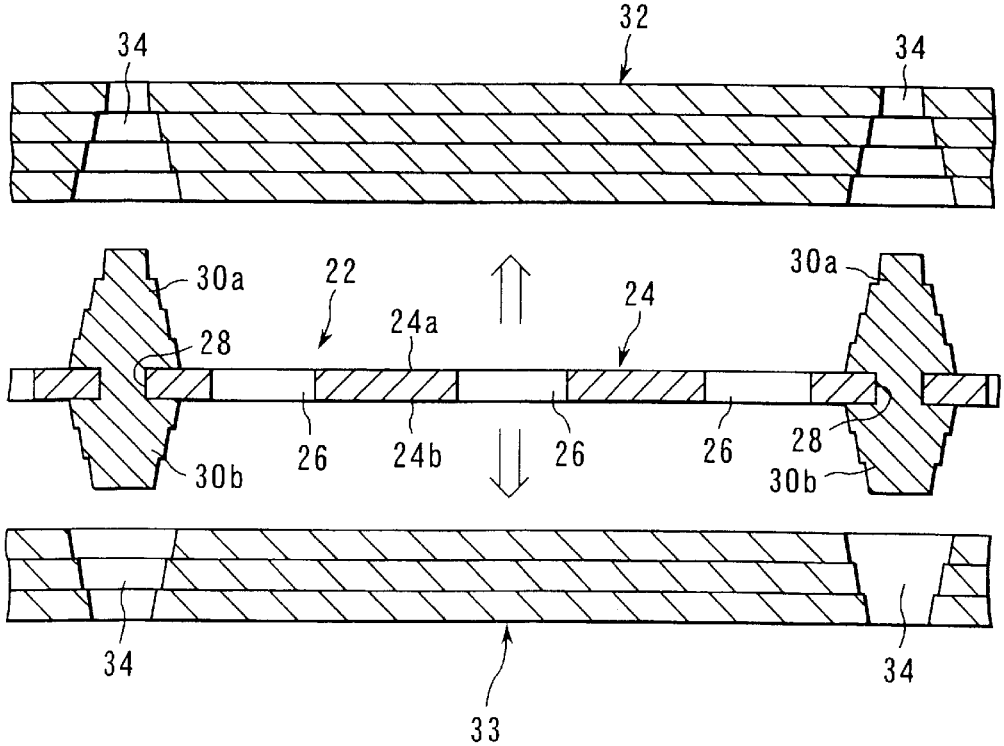

After that, the first and second molds 32 and 33 and the grid 24 are cooled to a predetermined temperature, and the first and second molds 32 and 33 are released from the grid 24, as shown in FIG. 7B. Hence, the spacer assembly 22 is completed.

When the SED is to be manufactured by using the spacer assembly 22 manufactured in the above manner, the rear plate 10 having the electron-emitting elements 18 and bonded with the side wall 14, and the face plate 12 having the phosphor screen 16 and metal back 17 are prepared in advance. The spacer assembly 22 is positioned on the rear plate 10, and the rear plate and the face plate 12 are arranged in a vacuum chamber. The interior of the vacuum chamber is evacuated, and the face plate 12 is bonded to the rear plate 10 through the side wall 14. Hence, an SED with the spacer assembly 22 is manufactured.

According to the spacer assembly 22 with the above arrangement and the SED having the spacer assembly 22, each spacer integrally has a plurality of steps stacked toward the extending end and with gradually decreasing diameters. Each step is formed in a tapered manner to be thinner toward the extending end, thus resulting in a stepped tapered shape as a whole, i.e., a substantial stepped truncated-conical shape. Therefore, a plurality of spacers can be integrally built on the grid by mold forming, and an easily manufacturable spacer assembly and SED can be obtained.

According to the spacer assembly manufacturing method described above, after the spacer forming material is arranged on the grid by using a mold, it is calcined, so that a plurality of spacers can be built at predetermined positions on the grid at once. Therefore, a spacer assembly with a plurality of small spacers can be manufactured easily, thus achieving a reduction in manufacturing cost and an increase in manufacturing efficiency.

Since the spacer forming material is calcined as it fills the through holes of the mold, the spacer forming material will not be squeezed and does not spread during calcination, and spacers each with a sufficiently large height and a high aspect ratio can be formed easily.

According to this embodiment, a glass paste containing an ultrasonic-curing binder and glass filler is used as the space forming material. Prior to calcination, the spacer forming material is cured by irradiation with ultraviolet rays. Also, the grid covered with an oxide film and molds covered with oxygen-resistant surface layers are used, so adhesion of the spacer forming material with respect to the grid can be increased to be higher than that with respect to the molds. Therefore, in the following calcining and releasing steps, the formed spacers are prevented from attaching to the molds, and spacers integral with the grid can be formed reliably.

According to this embodiment, each mold is formed by stacking a plurality of metal thin plates each having through holes. Usually, it is very difficult to form spacer-forming small through holes with a diameter of several 100 $\mu$m in a metal plate with a thickness of about 1 mm or more. If the metal thin plate has a thickness of about 0.1 mm to 0.3 mm, small through holes can be formed in it comparatively easily by etching, laser radiation, or the like. Therefore, when a plurality of metal thin plates having through holes are stacked as in this embodiment, a mold having through holes with a desired height can be obtained easily.

In this mold, the through holes formed in each metal thin plate are tapered, and their diameters differ from one metal thin plate to another. Hence, when stacking these plurality of metal thin plates, even if they are slightly misaligned, the through holes of the respective metal thin plates can communicate with each other reliably, so a mold having desired through holes can be obtained. Furthermore, since the mold is covered with a surface layer having releasability with respect to the spacer forming material, the spacer forming material will not easily attach to the interiors of the through holes of the mold. Thus, the mold can be repeatedly used for the manufacture of the spacer assembly.

An SED having a spacer assembly according to a second embodiment of the present invention, and a method of manufacturing this spacer assembly will be described.

Figure 8:
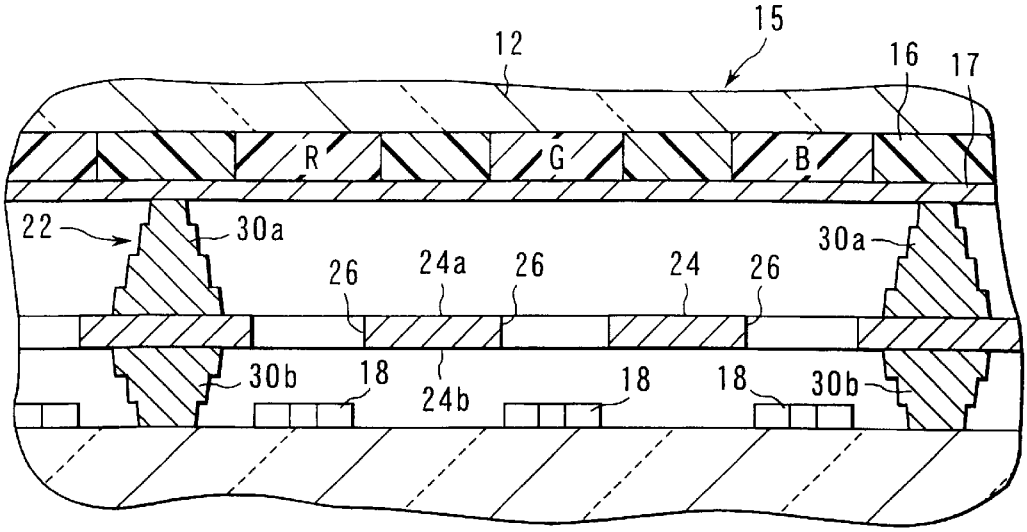
FIG. 8 is a sectional view of a surface conduction type electron-emitting apparatus with a spacer assembly according to the second embodiment of the present invention.

As shown in FIG. 8, according to the second embodiment, a grid 24 of a spacer assembly 22 has no spacer holes, and first and second spacers 30*a* and 30*b* are integrally formed with the grid 24 to be independent of each other.

More specifically, the plurality of first spacers 30*a* stand vertically on a first surface 24*a* of the grid 24 between apertures 26, and abut against the inner surface of a face plate 12 through a metal back 17 and the black-colored layers of a phosphor screen 16. The plurality of second spacers 30*b* stand on a second surface 24*b* of the grid 24 between the apertures 26, abut against the inner surface of a rear plate 10, and are arranged to be aligned with the first spacers 30*a*. Other arrangements are the same as those of the SED according to the first embodiment described above. The same portions are denoted by the same reference numerals, and a detailed description thereof will be omitted.

Figure 9A:
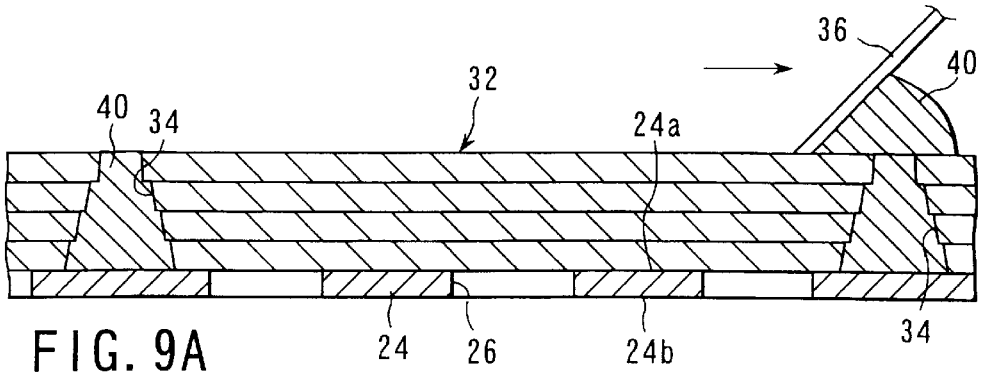
FIGS. 9A and 9B are sectional views respectively showing the steps in manufacturing the spacer assembly according to the second embodiment.

To manufacture a spacer assembly 22 with the above arrangement, first, as shown in FIG. 9A, a first mold 32 is brought into tight contact with the first surface 24*a* of the grid such that the large-diameter sides of through holes 34 are located on the grid 24 side, and is positioned such that the respective through holes are located between the apertures 26 of the grid. Subsequently, a spacer forming material 40 in the form of paste is supplied from the outer surface of the first mold 32 by using a squeegee 36, to fill the through holes 34 of the first mold 32. As the spacer forming material 40 and first mold 32, those that are identical to those of the embodiment described above are used.

Figure 9B:
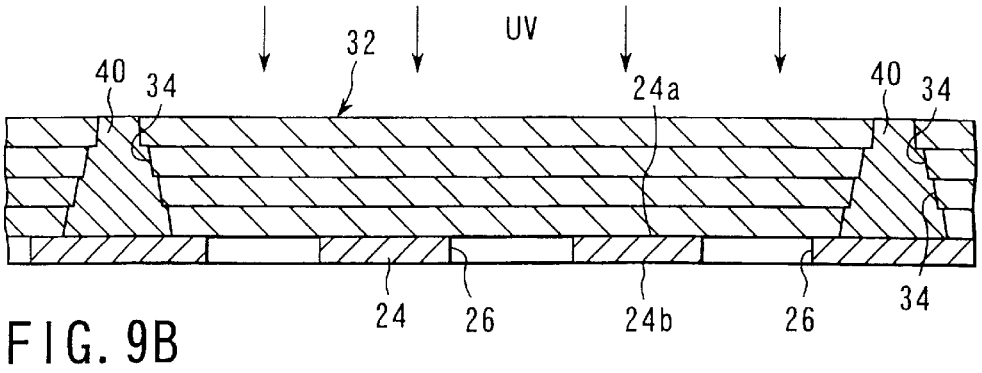

Subsequently, as shown in FIG. 9B, the spacer forming material 40 which fills the through holes 34 is irradiated with ultraviolet rays (UV) from the outer surface of the first mold 32, so it is UV-cured. Thus, adhesion of the spacer forming material 40 with respect to the grid 24 is increased to be higher than that of the spacer forming material with respect to the first mold 32.

Figure 10A:
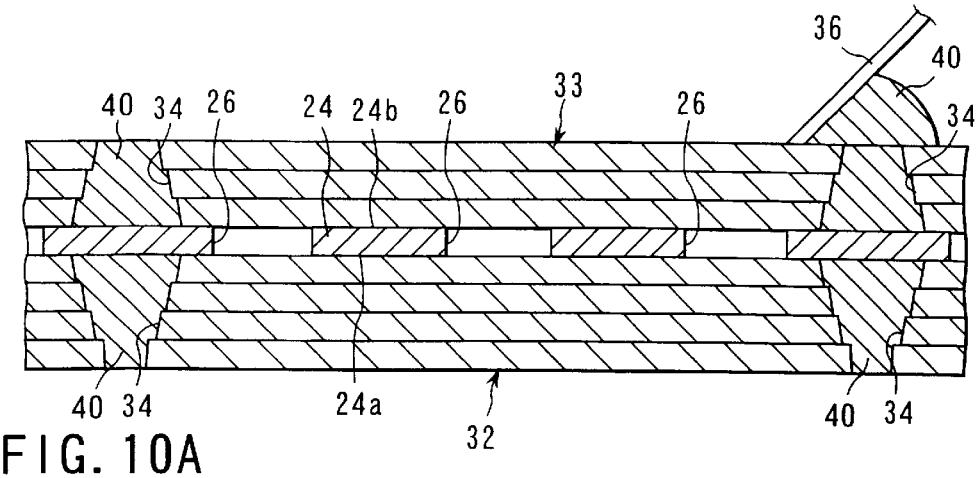
FIGS. 10A to 10C are sectional views respectively showing the steps in manufacturing the spacer assembly according to the second embodiment.

After that, as shown in FIG. 10A, while the grid 24 and first mold 32 are held in tight contact with each other, a second mold 33 is brought into tight contact with the second surface 24*b* of the grid such that the large-diameter sides of through holes 34 are located on the grid 24 side, and is positioned such that the respective through holes are located between the apertures 26 of the grid. Then, the first mold 32, grid 24, and second mold 33 are fixed to each other by using a clamper (not shown) or the like.

Subsequently, the spacer forming material 40 in the form of paste is supplied from the outer surface of the first mold 32 by using the squeegee 36, to fill the through holes 34 of the second mold 32. As the second mold 33, one which is identical to that of the embodiment described above is used.

Figure 10B:
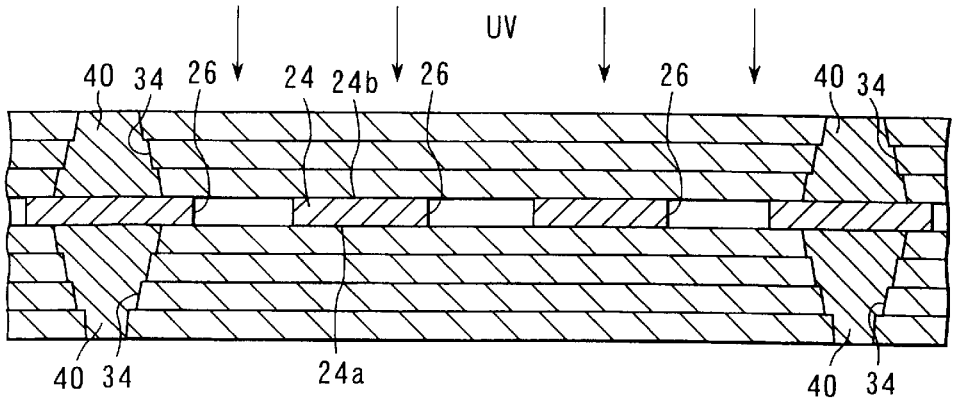

After that, as shown in FIG. 10B, the spacer forming material 40 which fills the through holes 34 is irradiated with ultraviolet rays from the outer surface of the second mold 33, so it is UV-cured. Thus, adhesion of the spacer forming material 40 with respect to the grid 24 is increased to be higher than that of the spacer forming material with respect to the second mold 33.

Figure 10C:
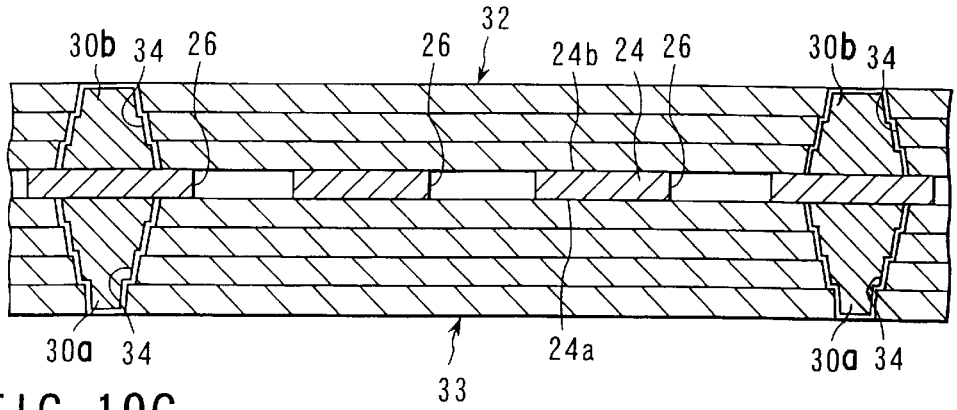

As shown in FIG. 10C, while the first and second molds 32 and 33 are in tight contact with the grid 24, they are heat-treated in the heating furnace to evaporate the binder from the spacer forming material 40, and then the spacer forming material is properly calcined at about 500° C. to 550° C. for 30 minutes to 1 hour. Hence, first and second spacers 30*a* and 30*b* integral with the grid 24 are formed.

Then, the first and second molds 32 and 33 and the grid 24 are cooled to a predetermined temperature, and the first and second molds 32 and 33 are released from the grid 24, thereby completing a spacer assembly 22. An SED having the spacer assembly 22 with the above arrangement is manufactured in accordance with steps similar to those of the embodiment described above.

In the second embodiment with the above embodiment, the same function and effect as those of the embodiment described above can also be obtained.

Figure 11:
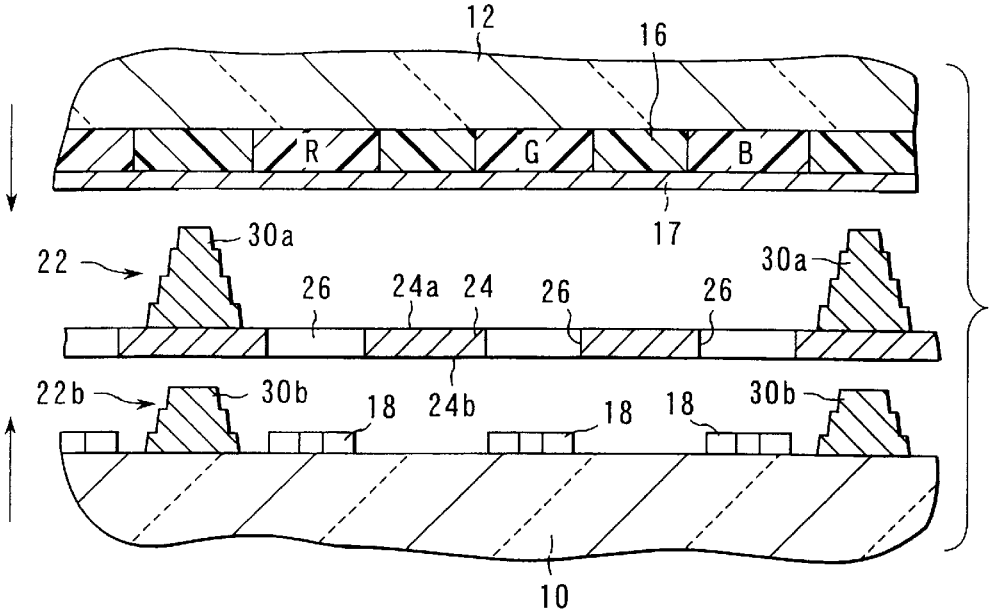
FIG. 11 is an exploded sectional view of a surface conduction type electron-emitting apparatus with a spacer assembly according to the third embodiment of the present invention.

In the first and second embodiments described above, the spacer assembly integrally has the first and second spacers on the two surfaces of the grid 24. Alternatively, spacers may be formed on only one surface of the grid, as in the third embodiment shown in FIG. 11.

More specifically, according to the third embodiment, a spacer assembly 22 has a grid 24 and a plurality of first spacers 30*a* integrally standing vertically on a first surface 24*a* of the grid. The first spacers 30*a* stand between apertures 26, and abut against the inner surface of a face plate 12 through a metal back 17 and black-colored layers of a phosphor screen 16.

A plurality of second spacers 30*b* integrally stand on the inner surface of the face plate 12, are positioned to be aligned with the first spacers 30*a*, and abut against a second surface 24*b* of the grid 24.

The first and second spacers 30*a* and 30*b* are formed into a stepped tapered shape to be thinner toward the extending end, i.e., into a stepped truncated-conical shape, in the same manner as in the embodiment described above. Other arrangements of the SED are the same as those of the embodiment described above. The same portions are denoted by the same reference numerals, and a detailed description thereof will be omitted.

In the third embodiment, the spacer assembly 22 is manufactured by the same method as that of the second embodiment described above. Note that the manufacturing steps for the second spacers will be omitted.

In the third embodiment, the plurality of second spacers 30*b* make up another spacer assembly 22*b* together with a glass substrate which forms the face plate 12. The spacer assembly 22*b* is also manufactured by the same method as that of the second embodiment.

More specifically, in place of the grid, the second mold 33 described above is brought into tight contact with the surface of the rear plate 10 formed of a glass substrate such that the large-diameter sides of through holes 34 are located on the rear plate side, and is positioned at a predetermined position. Subsequently, a spacer forming material in the form of paste is supplied from the outer surface of the second mold 33 to fill the through holes 34 of the second mold 32. As the spacer forming material, one which is identical to that of the embodiment described above is used.

Subsequently, the spacer forming material which fills the through holes is irradiated with ultraviolet rays, so it is UV-cured. Thus, adhesion of the spacer forming material with respect to the rear plate 10 is increased to be higher than that of the spacer forming material with respect to the second mold 33. The glass substrate that forms the rear plate 10 need not have an oxide film on its outer surface, since it is an oxide itself.

While the second mold 33 is in tight contact with the rear plate 10, this structure is heat-treated in a heating furnace to evaporate the binder from the spacer forming material, and then the spacer forming material is properly calcined. Hence, second spacers 30*a* integral with the rear plate 10 are formed.

Then, the second mold 33 and rear plate 10 are cooled to a predetermined temperature, and the second mold 33 is released, thereby completing a spacer assembly 22*b* integrally having the rear plate 10 and second spacers 30*b*.

In the third embodiment with the above arrangement as well, the same function and effect as those of other embodiments described above can be obtained.

Figure 12:
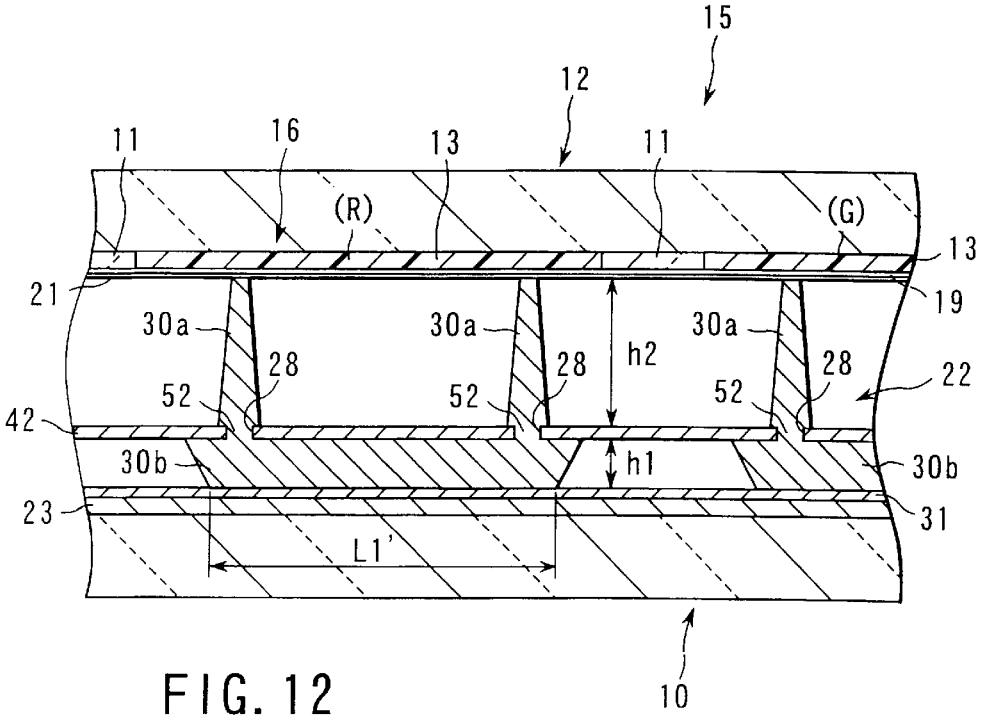
FIG. 12 is a sectional view showing an SED according to the fourth embodiment of the present invention.

An SED according to a fourth embodiment of the present invention will be described. As shown in FIG. 12, a spacer assembly 22 (to be described later) is disposed between a face plate 12 and rear plate 10 which constitute a vacuum envelope 15, and has an electrode plate connected to a predetermined potential in order to prevent abnormal discharge between these plates. The face plate 12 and rear plate 10 are supported by the spacer assembly 22 against the atmospheric pressure, and the predetermined gap between the plates is maintained at, e.g., 1.6 mm.

The face plate 12 has an insulating substrate made of non-alkali glass, and a phosphor screen 16 formed on the inner surface of the insulating substrate. The phosphor screen 16 has striped phosphor layers 13 having red (R), blue (B), and green (G) light-emitting characteristics and arranged at a 0.6-mm pitch, and band-like light-shielding layers 11 arranged between the phosphor layers 13 to improve the contrast ratio.

A conductive thin film layer 19 made of aluminum or an aluminum alloy is formed on the phosphor screen 16, and a deposited getter layer 21 made of barium (Ba) is formed on the conductive thin film layer 19. This conductive thin film layer 19 of the face plate 12 serves as an anode electrode. The deposited getter layer 21 is formed by vapor-depositing a getter material in a vacuum chamber before adhering the face plate 12 and rear plate 10 in the vacuum chamber. When the series of steps from vapor deposition to sealing of the getter material are performed in a vacuum state without being exposed to the atmosphere, a deposited getter layer 21 with a high performance can be obtained.

Figure 13:
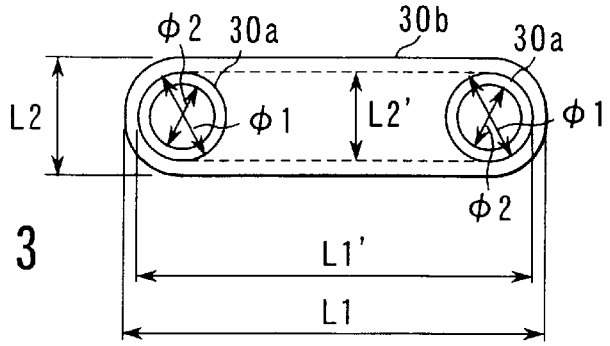
FIG. 13 is a schematic plan view of the first and second spacers of the SED according to the fourth embodiment which are seen from the second spacer side.
Figure 14:
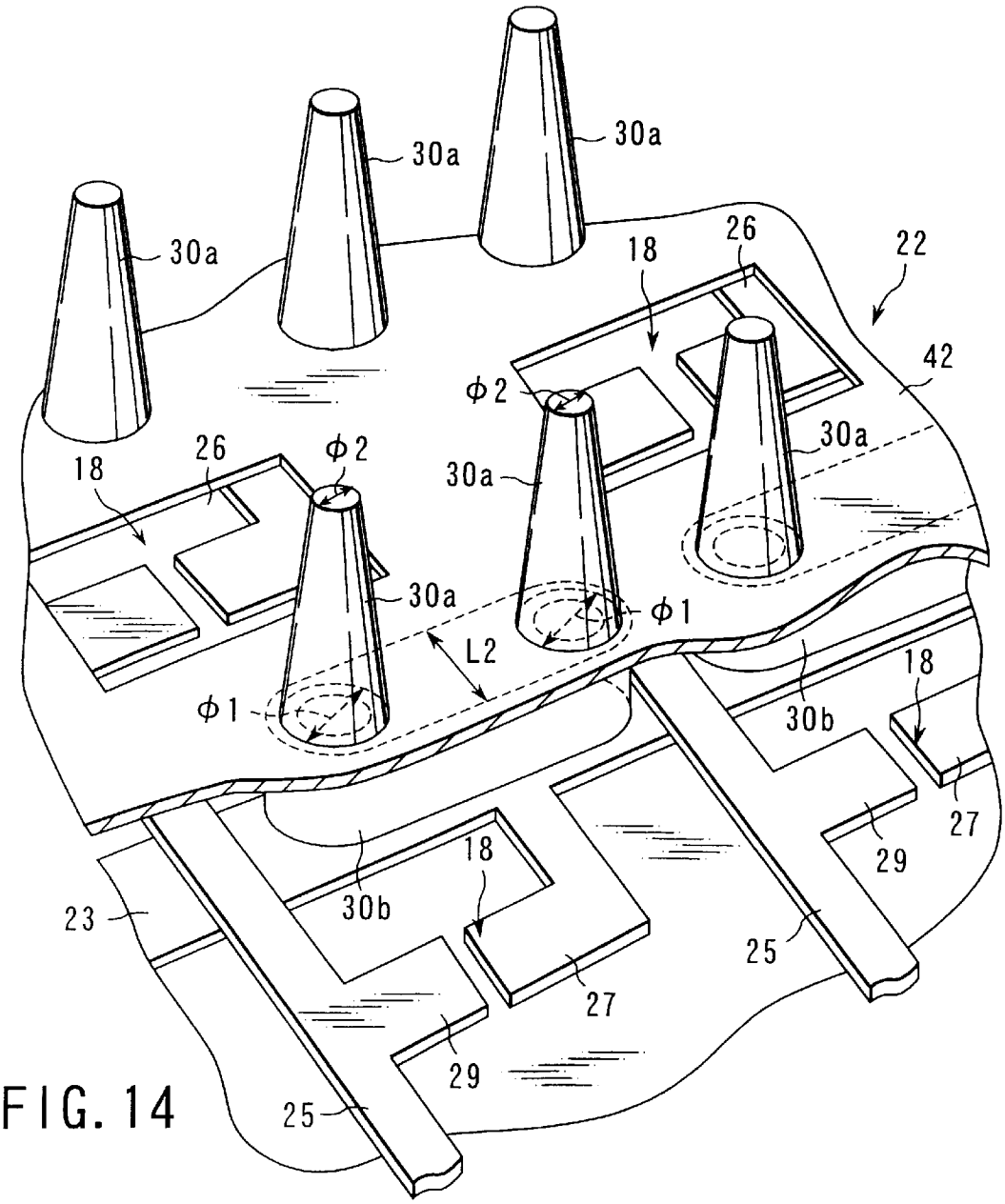
FIG. 14 is a schematic perspective view showing part of the spacer assembly of the SED according to the fourth embodiment.

As shown in FIGS. 12 to 14, the rear plate 10 has an insulating substrate made of non-alkali glass. A plurality of scanning electrodes 23 and signal electrodes 25 run on the inner surface of the insulating substrate in the form of a matrix. Gate electrodes 27 and emitter electrodes 29 respectively extending from the scanning electrodes and signal electrodes are formed in the vicinities of the intersections of the scanning electrodes 23 and signal electrodes 25.

The gate electrodes 27 and emitter electrodes 29 are arranged to oppose each other at a predetermined gap, e.g., 50 $\mu$m. Although not shown, for example, a graphite film is arranged between the electrodes 27 and 29 to oppose them at a gap of 5 $\mu$m, thereby making up a surface conduction type electron-emitting element 18. A protection film 31 is formed on each scanning electrode 23.

The spacer assembly 22 is provided between the face plate 12 and rear plate 10 with the above arrangement, to support the face plate and rear plate against the atmospheric pressure. The spacer assembly 22 will be described in detail hereinafter.

As shown in FIGS. 12 and 14, the spacer assembly 22 has an electrode plate 42 arranged for preventing abnormal discharge between the face plate 12 and rear plate 10. The electrode plate 42 is made of an iron-nickel alloy to have a thickness of 0.1 mm, and its surface is oxidized. Although depending on its size, the electrode plate 42 preferably has a thickness of about 0.1 mm to 0.25 mm, if it is to match the effective display region with a diagonal size of 20 inches or more, so that a desired strength is ensured.

To ensure easy manufacture, the electrode plate 42 may be divided into a plurality of portions. Then, however, the boundaries of the divisional portions adversely affect the display performance. Hence, a large electrode plate with a size matching an effective display region 3 is preferably used where possible.

The electrode plate 42 is arranged between the face plate 12 and rear plate 10 to be parallel to them. The electrode plate 42 has a plurality of rectangular holes 26, each with a size of 250 $\mu$m×180 $\mu$m and allowing to pass electron beams emitted from the surface conduction type electron-emitting elements 18, to oppose the surface conduction type electron-emitting elements 18. The electrode plate 42 also has a plurality of circular spacer holes 28 for connecting the first and second spacers (to be described later).

The electrode plate 42 has a first surface opposing the face plate 12 and a second surface opposing the rear plate 12. A plurality of first spacers 30*a* are formed on the first surface to be integral with the electrode plate 42, and a plurality of second spacers 30*b* are formed on the second surface to be integral with the electrode plate 42. The first and second spacers 30*a* and 30*b* are connected to each other through connecting portions 52 arranged in the spacer holes 28 formed in the electrode plate 42. In this embodiment, one second spacer 30*b* is connected to two first spacers 30*a* through the connecting portions 52.

As shown in FIGS. 12 to 14, the second spacers 30*b* are arranged on the scanning electrodes 23 through the protection films 31 to correspond to the surface conduction type electron-emitting elements 18, and extend along the interconnection. Each second spacer 30*b* has an elongated elliptic section, and is formed such that its length L1 in the direction of interconnection on the electrode plate 42 side is 0.4 mm, its length L2 in a direction perpendicular to the direction of interconnection is 500 $\mu$m, its length L1' in the direction of interconnection on the rear plate 10 side is 0.35 mm, its length L2' in a direction perpendicular to the direction of interconnection is 400 $\mu$m, and its height h1 is 0.5 mm.

Two first spacers 30*a* are arranged for one second spacer 30*b*. Each first spacer 30*a* has a columnar shape with some taper, and is formed such that its end on the electrode plate 42 side has a diameter ϕ1 of 320 μm, its end on the electrode plate 42 side has a diameter ϕ2 of 230 μm, and its height h2 is 1.0 mm.

More specifically, in the fourth embodiment, the first spacers 30*a* are formed to have a sufficiently large aspect ratio (the ratio of the height to the length of the end on the electrode plate 42 side in the direction of the major axis of the section) when compared to that of the second spacers 30*b*. The second spacers 30*b* have a height about half that of the first spacers 30*a*.

Two adjacent first spacers 30*a* are connected to one second spacer 30*b* through the spacer holes 28 of the electrode plate 42, i.e., through the connecting portions 52, and are integrated with the second spacer 30*b* and electrode plate 42. The diameter of each of the connecting portions 52 and spacer holes 28 is smaller than the diameter ϕ1 of the end of the first spacer 30*a* on the electrode plate 42 side.

When the spacer assembly 22 with the above arrangement is disposed in the vacuum envelope 15, the electrode plate 42 opposes the face plate 12 and rear plate 10 to be parallel to them, and is connected to a predetermined potential to prevent abnormal discharge between the plates. Each second spacer 30*b* abuts against the rear plate 10 through the protection film 31 and scanning electrode 23. Each first spacer 30*a* abuts against the face plate 12 through the deposited getter layer 21, conductive thin film layer 19, and phosphor screen 16, to support the face plate 12 and rear plate 10 against the atmospheric pressure.

In the SED with the above arrangement, since the second spacers 30*b* of the spacer assembly 22 are arranged close to the electron-emitting elements 18 and since they are as low as 0.5 mm, although they are arranged over a sufficiently large area along the scanning electrodes 23, charging of the second spacers 30*b* does not easily influence the trajectories of the electron beams.

Although the first spacers 30*a* are as sufficiently high as 1.0 mm when compared to the second spacers 30*b*, since their aspect ratio is sufficiently large, they do not easily influence the trajectories of the electron beams. Since the first and second spacers 30*a* and 30*b* are arranged uniformly with respect to the corresponding surface conduction type electron-emitting elements 18, local display nonuniformity and the like caused by charging of the spacers do not occur easily.

Furthermore, since the spacer assembly 22 is arranged to have sufficiently large contact areas with the face plate 12 and rear plate 10, a sufficiently large structural strength can be ensured for the SED. Therefore, an SED that can prevent a decrease in display quality due to charging of the spacers can be obtained while a sufficiently large strength is ensured.

A method of manufacturing the spacer assembly 22 with the above arrangement will be described.

Figure 15A:
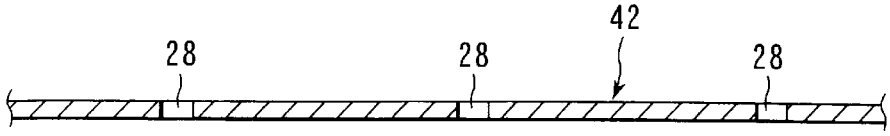
FIGS. 15A to 15C are sectional views respectively showing the steps in manufacturing the spacer assembly.

First, as shown in FIG. 15A, an electrode plate 42 made of an iron-nickel alloy with a thickness of 0.1 mm and with an oxidized surface is prepared. The surface of the electrode plate 42 is oxidized in order to improve the adhesion with the spacer forming material (to be described later).It is particularly preferable to form a spinel type oxide film. A plurality of apertures 26 (see FIG. 3) for electron beam transmission (to be described later) and a plurality of spacer holes 28 for connecting first and second spacers 30*a* and 30*b* to each other are formed in the electrode plate 42 in advance. The spacer holes 28 are formed by photoetching, laser processing, or the like.

Figure 15B:
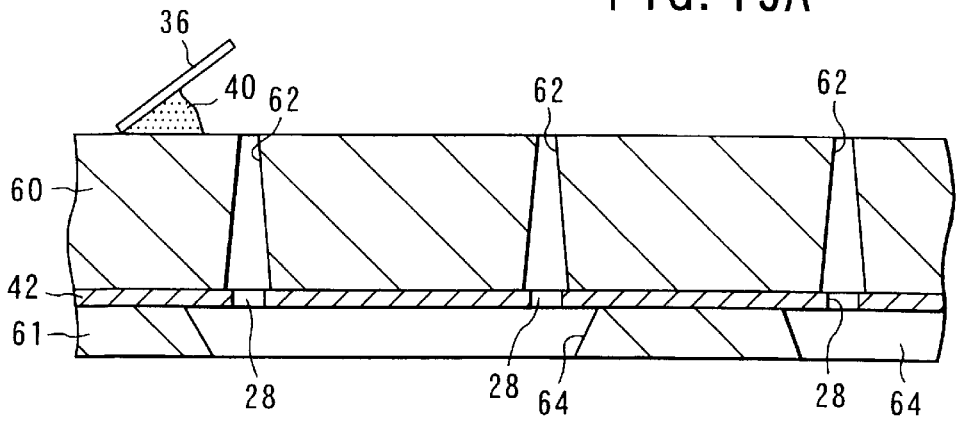

Subsequently, as shown in FIG. 15B, molds 60 and 61 are aligned and arranged on and under the electrode plate 42, and are brought into tight contact with and fixed to the electrode plate 42 by a damper or the like (not shown).In FIG. 15B, the mold 60 arranged on the upper surface of the electrode plate 42 has a plurality of through holes 62 for forming first spacers 30*a*. The mold 61 arranged on the lower surface of the electrode plate 42 has a plurality of through openings 64 for forming second spacers 30*b*.

The molds 60 and 61 is formed by respectively stacking 4 and 2 metal plates each made of an iron iron-nickel alloy of the same type as that of the electrode plate 42 and with a thickness of about 0.28 mm. This thickness is determined considering the ratio of the solid content of the spacer forming material (to be described later) and the desired spacer height. Through holes 62 and openings 64 are formed by laser processing, etching, or the like. Each through hole 62 and opening 64 are formed in a tapered manner, as shown in FIG. 15B, considering the releasability of the molds 60 and 61.

The surfaces of the molds 60 and 61 are subjected to a process for achieving releasability with respect to the spacer forming material and for preventing oxidation of the molds themselves, e.g., eutectic plating of Ni—P with fine particles of Teflon, nitride, oxide, or carbide. As the anti-oxidation process, eutectic plating of Ni—Co and Ni—P with a high-melting metal such as W, Mo, or Re is suitably used, in addition to that described above.

After the molds 60 and 61 are positioned and arranged with respect to the electrode plate 42 as described above, the through holes 62 of the mold 60 and the openings 64 of the mold 61 are filled with a spacer forming material 40 by, e.g., a squeegee 36. The spacer forming material 40 may be charged to fill the through holes 62 of the mold 60 at once through the openings 64 of the mold 61. In either case, care must be taken so bubbles will not form in the spacer forming material 40 that fills the through holes 62 of the mold 60 and the openings 64 of the mold 61. An excessive portion of the spacer forming material 40 leaking from the through holes 62 and openings 64 is wiped off with a squeegee or the like. As the spacer forming material 40, a glass paste containing at least a solvent-free ultraviolet-curing binder and a glass filler as a structural material is used.

Figure 15C:
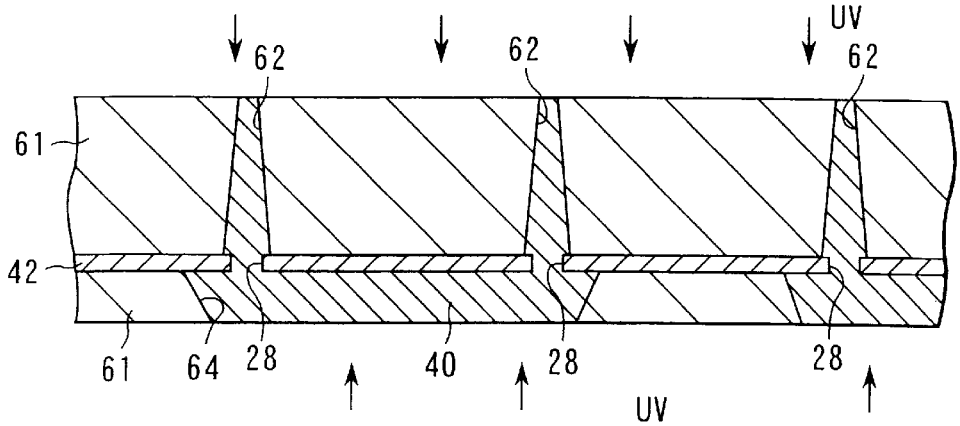

Subsequently, as shown in FIG. 15C, the charged spacer forming material 40 is irradiated with ultraviolet (UV) rays from the outer surfaces of the molds 60 and 61, to sufficiently cure the ultraviolet-curing binder contained in the spacer forming material 40.

As shown in FIG. 13, first spacers 30*a* are arranged to vertically overlap the corresponding second spacer 30*b*, and particularly each second spacer 30*b* is arranged also in a region between the two corresponding first spacers 30*a*. The electrode plate 42 has spacer holes 28 corresponding to the first spacers 30*a* to each have a diameter smaller than that of the electrode plate-side end of each first spacer 30*a*. Therefore, as seen also from FIG. 15C, the spacer forming material 40 that fills the through holes 62 of the mold 60 can be sufficiently irradiated with the UV rays from the upper surface of the mold 60 and from the through holes 62, despite of the high aspect ratio. Therefore, adhesion of the spacer forming material 40 with respect to the electrode plate 42 with an oxidized surface is ensured, and at the same time appropriate releasability is ensured for the molds 60 and 61.

Figure 16A:
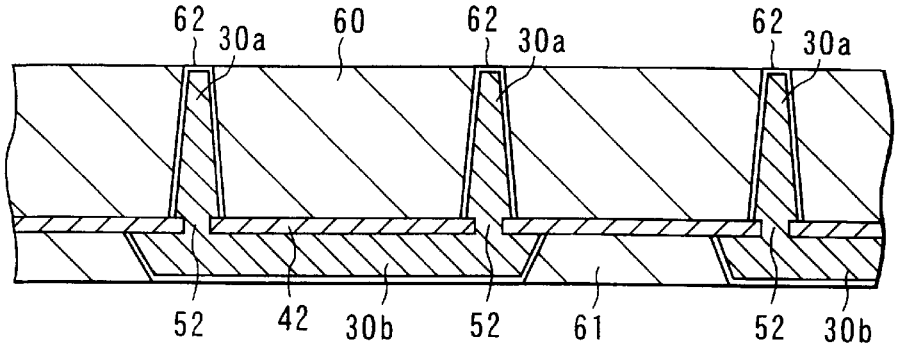
FIGS. 16A and 16B are sectional views respectively showing the steps in manufacturing the spacer assembly.

Subsequently, as shown in FIG. 16A, while the molds 60 and 61 are in tight contact with the electrode plate 42, this structure is preliminarily calcined in the heating furnace at 400° C. to 450° C. for 1 hour, thereby burning off the binder component in the spacer forming material 40. Furthermore, this structure is properly calcined in the heating furnace at 500° C. for 45 minutes, so the molds 60 and 61 are connected to each other through the connecting portions 52 formed in the spacer holes 28, and the first and second spacers 30*a* and 30*b* integrated with the electrode plate 42 are formed. The suitable conditions for this proper calcination are at 500° C. to 550° C. and 30 minutes to 1 hour, although they depend on the size of the spacers and the like.

Figure 16B:
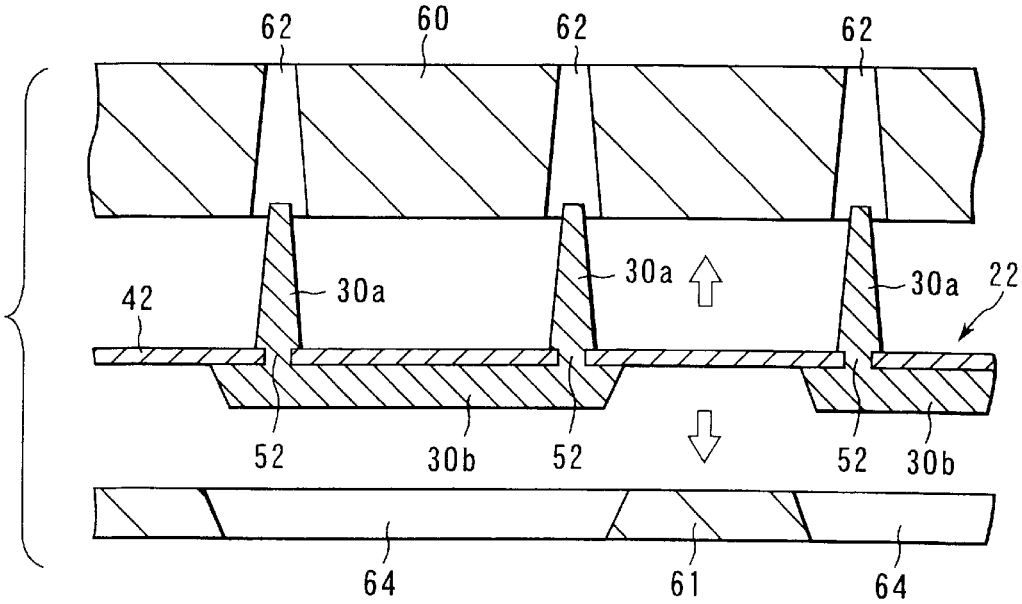

After that, the resultant structure is cooled to a predetermined temperature while performing distortion removing annealing, and the molds 60 and 61 are released from the electrode plate 42, as shown in FIG. 16B, thus completing the spacer assembly 22.

When the spacer assembly 22 is formed in accordance with the above steps, first spacers 30*a* integrally formed with the electrode plate 42 and having a high aspect ratio can be obtained comparatively easily, and the manufacturing cost can be reduced and the productivity can be improved.

More specifically, according to the embodiment described above, the ultraviolet-curing binder is mixed in the spacer forming material 40*a* and cured, so choices are allowed for the adhesion with respect to the molds 60 and 61 and electrode plate 42, while accordingly maintaining an appropriate spacer shape. As a result, the electrode plate 42 can be calcined with the molds 60 and 61 being in tight contact with it. Particularly, the first spacers 30*a* extending from the electrode plate 42 toward the face plate 12 can have a high aspect ratio of 2.0 or more. To allow choices for the adhesion, the method of mixing the ultraviolet-curing binder is effective in terms of productivity, manufacturing cost, and the like. However, the present invention is not limited to this.

Also, the first spacers 30*a* can be sufficiently irradiated with the UV rays from the side of the mold 61 for forming the second spacers 30*b*. Thus, curing nonuniformity of the spacer forming material 40 is prevented, and first spacers 30*a* with a high aspect ratio can be obtained.

In the fourth embodiment described above, the height of each second spacer 30*b* is about half the height of the first spacer 30*a*. The height of the second spacer 30*b* is desirably smaller than that of the first spacers 30*a*, and is particularly suitably half that of the first spacer 30*a* or less.

In the spacer assembly 22 of this embodiment, two first spacers 30*a* branched into two portions on the face plate 12 side are connected to one second spacer 30*b* arranged on the rear plate 10 side. Alternatively, a first spacer branched into three or more portions may be connected to one second spacer 30*b*. Since charging of the first spacers 30*a* arranged on the face plate 12 side influences the trajectories of the electron beams, the first spacers 30*a* preferably have a high aspect ratio and small entire surface area. Therefore, the first spacer is preferably constituted by first spacers 30*a* branched into a plurality of portions. The spacer hole 28 corresponding to the first spacer 30*a* has one opening. Alternatively, an aggregate of a plurality of openings may constitute the spacer hole 28.

The second spacers 30*b* have elliptic sections. Alternatively, the second spacers 30*b* may have L- or cross-shaped sections.

When the SED with the above arrangement is employed, decrease in display quality caused by charging of the spacers can be prevented while a sufficiently high strength for the spacers is maintained.

The present invention is not limited to the embodiments described above, and various modifications can be made within the scope of the invention. For example, the spacer forming material is not limited to the glass paste described above, and can be appropriately selected when necessary. The diameter and height of the spacers, and size, material, and the like of other constituent elements can be appropriately selected when necessary. Bonding of the metal thin plates that constitute the mold is not limited to diffusion bonding, but the metal thin plates may be bonded to each other by brazing, ultrasonic bonding, or the like.

In the embodiments described above, after the molds are brought into tight contact with the grid or glass substrate, the through holes of the molds are filled with the spacer forming material. Alternatively, after the through holes of the molds are filled with the spacer forming material, the molds may be arranged to be in tight contact with the grid or glass substrate.

Furthermore, the present invention is not limited to the SED described above, but can be applied in various apparatuses as far as they are flat panel display apparatuses with spacers. For example, although the above embodiment is exemplified by an SED, the present invention can also be applied to other flat panel display apparatuses such as an FED or PDP. As shown in the third embodiment described above, the present invention is not limited to a spacer assembly with a grid, but can be applied to a spacer assembly having a metal substrate or glass substrate with no apertures and a plurality of spacers, a flat panel display apparatus, and a method of manufacturing them.

As has been described above in detail, an easily manufacturable spacer assembly for a flat panel display apparatus, a spacer assembly manufacturing method, a flat panel display apparatus having spacers with a high aspect ratio, a method of manufacturing an easily manufacturable flat panel display apparatus, and a mold used in the manufacture of a spacer assembly can be provided. According to the present invention, a flat panel display apparatus that can prevent a decrease in display quality caused by charging of spacers, while ensuring a sufficiently high strength for the spacers, can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a spacer assembly having a substrate and a plurality of columnar spacers formed on the substrate and used for a flat panel display apparatus, the method comprising:

preparing a substrate and a mold having a number of through holes;

arranging the mold on a surface of the substrate to be in tight contact therewith and filling the through holes of the mold with a spacer forming material;

curing the spacer forming material by irradiation with radiation, thereby increasing adhesion of the spacer forming material with respect to the surface of the substrate to be higher than that of the spacer forming material with respect to the mold;

calcining the spacer forming material with the mold being in tight contact with the substrate, thereby forming spacers on the substrate; and after cooling, releasing the mold from the substrate.

2. A method of manufacturing a spacer assembly according to claim 1, wherein a glass paste containing at least an ultraviolet-curing binder and a glass filler is used as the spacer forming material, and the spacer forming material is cured by irradiation with ultraviolet rays as the radiation.

3. A method of manufacturing a spacer assembly according to claim 2, wherein the spacer forming material is heat-treated to remove the binder, and is thereafter properly calcined.

4. A method of manufacturing a spacer assembly according to claim 1, wherein a metal plate having a surface formed with an oxide film is used as the substrate.

5. A method of manufacturing a spacer assembly according to claim 1, wherein a grid formed of a metal plate having a number of apertures and a surface formed with an oxide film is used as the substrate.

6. A method of manufacturing a spacer assembly according to claim 1, wherein the mold is subjected to surface treatment which imparts releasability with respect to the spacer forming material and oxidation resistance.

7. A method of manufacturing a spacer assembly having a substrate and a plurality of columnar spacers formed on the substrate and used for a flat panel display apparatus, comprising:

preparing a substrate and a mold having a number of through holes;

filling the through holes of the mold with a spacer forming material and arranging the mold on a surface of the substrate to be in tight contact therewith;

curing the spacer forming material by irradiation with radiation, thereby increasing adhesion of the spacer forming material with respect to the surface of the substrate to be higher than that of the spacer forming material with respect to the mold;

calcining the spacer forming material with the mold being in tight contact with the substrate, thereby forming spacers on the substrate; and after cooling, releasing the mold from the substrate.

8. A method of manufacturing a spacer assembly having a substrate and a plurality of columnar spacers formed on the substrate and used for a flat panel display apparatus, comprising:

preparing a substrate having opposing first and second surfaces and a plurality of through holes, and first and second molds each having a plurality of through holes;

arranging the first and second molds on the first and second surfaces of the substrate to be in tight contact therewith such that the holes of the substrate and the through holes of the first and second molds are aligned with each other, and thereafter filling the holes of the substrate and the through holes of the first and second mold with a spacer forming material;

curing the spacer forming material by irradiation with radiation, thereby increasing adhesion of the spacer forming material with respect to the substrate to be higher than that of the spacer forming material with respect to the first and second molds;

calcining the spacer forming material with the first and second molds being in tight contact with the substrate, thereby forming spacers on the first and second surfaces of the substrate; and after cooling, releasing the first and second molds from the substrate.

9. A method of manufacturing a spacer assembly having a substrate and a plurality of columnar spacers formed on the substrate and used for a flat panel display apparatus, comprising:

preparing a substrate having opposing first and second surfaces, and first and second molds each having a plurality of through holes;

arranging the first mold on the first surface of the substrate to be in tight contact therewith, and thereafter filling the through holes of the first mold with a spacer forming material;

curing the spacer forming material by irradiation with radiation, thereby increasing adhesion of the spacer forming material with respect to the first surface of the substrate to be higher than that of the spacer forming material with respect to the first mold;

arranging the second mold on the second surface of the substrate to be in tight contact therewith, and filling the through holes of the second mold with a spacer forming material;

curing the spacer forming material by irradiation with radiation, thereby increasing adhesion of the spacer forming material with respect to the second surface of the substrate to be higher than that of the spacer forming material with respect to the second mold;

after irradiation with the radiation, calcining the spacer forming material with the first and second molds being in tight contact with the substrate, thereby forming spacers on the first and second surfaces of the substrate; and after cooling, releasing the first and second molds from the substrate.

10. A method of manufacturing a flat panel display apparatus having a first substrate with an inner surface with a phosphor layer formed thereon, a second substrate arranged to oppose the first substrate at a predetermined gap and provided with phosphor exciting sources configured to excite the phosphor layer, a frame-like side wall that joins peripheries of the first and second substrates, a plate-like grid arranged between the first and second substrates to oppose the substrates and having a number of holes located to correspond to the phosphor exciting sources, a number of columnar first spacers arranged between the first substrate and the grid, and a number of columnar second spacers arranged between the second substrate and the grid, the method comprising:

preparing a grid and a mold having a number of through holes;

arranging the mold on a surface of the grid to be in tight contact therewith and filling the through holes of the mold with a spacer forming material;

curing the spacer forming material by irradiation with radiation, thereby increasing adhesion of the spacer forming material with respect to the surface of the grid to be higher than that of the spacer forming material with respect to the mold;

calcining the spacer forming material with the mold being in tight contact with the substrate, thereby forming the large number of first spacers on the grid; and after cooling, releasing the mold from the grid.

11. A method of manufacturing a flat panel display apparatus having a first substrate with an inner surface with a phosphor layer formed thereon, a second substrate arranged to oppose the first substrate at a predetermined gap and provided with phosphor exciting sources configured to excite the phosphor layer, a frame-like side wall that joins peripheries of the first and second substrates, a plate-like grid arranged between the first and second substrates to oppose the substrates and having a number of apertures located to correspond to the phosphor exciting sources, a number of columnar first spacers arranged between the first substrate and the grid, and a number of columnar second spacers arranged between the second substrate and the grid, the method comprising:

preparing a grid having opposing first and second surfaces and a plurality of spacer holes, and first and second molds each having a plurality of through holes;

arranging the first and second molds on the first and second surfaces of the substrate to be in tight contact therewith such that the spacer holes of the grid and the through holes of the first and second molds are aligned with each other, and thereafter filling the through holes of the first and second molds with a spacer forming material;

curing the spacer forming material by irradiation with radiation, thereby increasing adhesion of the spacer forming material with respect to the first and second surfaces of the substrate to be higher than that of the spacer forming material with respect to the first and second molds;

calcining the spacer forming material with the first and second molds being in tight contact with the grid, thereby forming first and second spacers on the first and second surfaces of the grid; and after cooling, releasing the first and second molds from the substrate.

12. A method of manufacturing a flat panel display apparatus according to claim 11, wherein a glass paste containing at least an ultraviolet-curing binder and a glass filler is used as the spacer forming material, and the spacer forming material is cured by irradiation with ultraviolet rays as radiation.

13. A method of manufacturing a flat panel display apparatus according to claim 12, wherein the spacer forming material is heat-treated to remove the binder, and is thereafter properly calcined.

14. A method of manufacturing a flat panel display apparatus according to claim 11, wherein a metal plate having a surface formed with an oxide film is used as the substrate.

15. A method of manufacturing a flat panel display apparatus according to claim 11, wherein the mold is subjected to surface treatment which imparts releasability with respect to the spacer forming material and oxidation resistance.

16. A flat panel display apparatus manufactured by the manufacturing method according to claim 11.

17. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates; and a spacer assembly having plate-like grid, arranged between the first and second substrates and having a number of apertures located to correspond to the phosphor exciting sources, and a plurality of spacers formed on the grid, and manufactured by the method of manufacturing a spacer assembly according to claim 1.

18. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates;

a plate-like grid arranged between the first and second substrates to oppose the substrates and having a number of apertures located to correspond to the phosphor exciting sources;

a plurality of columnar first spacers arranged between the grid and the first substrate, a diameter of that end of each of the first spacers which abuts against the first substrate being smaller than that of a grid-side end thereof; and a plurality of columnar second spacers arranged between the grid and the second substrate, a diameter of that end of each of the second spacers which abuts against the second substrate is smaller than that of a grid-side end thereof, wherein a height of each of the first spacers is larger than that of each of the second spacers.

19. A flat panel display apparatus according to claim 18, wherein the first spacers have an aspect ratio of not less than 2, and the second spacers have an aspect ratio of not less than 0.6.

20. A flat panel display apparatus according to claim 18, wherein the grid has a first surface opposing the first substrate and a second surface opposing the second substrate, and the first spacers stand on the first surface of the grid to be integral therewith and the second spacers stand on the second surface of the grid to be integral therewith.

21. A flat panel display apparatus according to claim 20, wherein the grid has a plurality of spacer holes formed between the apertures, each of the spacer holes having a diameter smaller than those of grid-side ends of the first and second spacers, and the first and second spacers are aligned with one of the spacer holes and are integrally formed with each other through the spacer holes.

22. A flat panel display apparatus according to claim 18, wherein the grid has a first surface opposing the first substrate and a second surface opposing the second substrate, and the first spacers stand on the first surface of the grid to be integral therewith and the second spacers stand on the second substrate to be integral therewith.

23. A spacer assembly used for a flat panel display apparatus, comprising:

a substrate; and a plurality of columnar spacers standing on the substrate to be integral therewith, wherein each of the spacers integrally has a plurality of steps stacked from the substrate toward an extending end and with diameters that decrease gradually, each of the steps being formed in a tapered shape to be thinner from the substrate toward the extending end.

24. A spacer assembly used for a flat panel display apparatus, comprising:

a plate-like grid having first and second opposing surfaces and a plurality of apertures;

a plurality of columnar first spacers standing on the first surface of the grid to be integral therewith; and a plurality of columnar second spacers standing on the second surface of the grid to be integral therewith, wherein each of the first and second spacers integrally including a plurality of steps stacked from the grid toward an extending end and with diameters that decrease gradually, and each of the steps being formed in a tapered shape to be thinner toward an extending end.

25. A spacer assembly according to claim 24, wherein the first spacers stand on the first surface of the grid between the apertures, and the second spacers stand on the second surface of the grid between the apertures and are aligned with the first spacers.

26. A spacer assembly according to claim 24, wherein the grid has a plurality of spacer holes formed between the apertures and each having a diameter smaller than those of ends of the first and second spacers on grid sides, and the first spacers stand on the first surface of the grid to overlap the spacer holes, and the second spacers stand on the second surface of the grid to overlap the spacer holes and are integrally connected to the first spacers through the spacer holes.

27. A method of manufacturing a spacer assembly having a plate-like grid with a number of apertures and a plurality of columnar spacers formed on the grid and used in a flat panel display apparatus, the method comprising:

preparing a plate-like grid having first and second surfaces;

preparing plate-like first and second molds having a number of stepped tapered through holes each having a diameter that decreases gradually from one end toward the other end thereof;

arranging the first mold on the first surface of the grid to be in tight contact with such that large-diameter sides of the through holes are located on a grid side, and filling the through holes of the first mold with a spacer forming material;

curing the spacer forming material by irradiation with radiation, thereby increasing adhesion of the spacer forming material with respect to the first surface of the grid to be higher than that of the spacer forming material with respect to the first mold;

arranging the second mold on the second surface of the grid to be in tight contact therewith such that large-diameter sides of the through holes are located on a grid side, and filling the through holes of the second mold with a spacer forming material;

curing the spacer forming material by irradiation with radiation, thereby increasing adhesion of the spacer forming material with respect to the second surface of the grid to be higher than that of the spacer forming material with respect to the second mold;

after irradiation with the radiation, calcining the spacer forming material with the first and second molds being in tight contact with the grid, thereby forming spacers on the first and second surfaces of the grid; and after cooling, releasing the first and second molds from the substrate.

28. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates; and a spacer assembly arranged between the first and second substrates, wherein the spacer assembly includes a plate-like grid having a number of apertures opposing the phosphor exciting sources, and a plurality of columnar spacers standing on the grid to be integral therewith, and each of the first and second spacers integrally has a plurality of steps stacked from the grid toward an extending end and with diameters that decrease gradually, and each of the steps is formed in a tapered shape to be thinner toward the extending end.

29. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates; and a spacer assembly arranged between the first and second substrates, wherein the spacer assembly includes a plate-like grid having first and second surfaces and a plurality of apertures opposing the phosphor exciting sources, a plurality of columnar first spacers standing on the first surface of the grid to be integral therewith and in contact with the first substrate, and a plurality of columnar second spacers standing on the second surface of the grid to be integral therewith and in contact with the second substrate, and each of the first and second spacers integrally has a plurality of steps stacked from the grid toward an extending end and with diameters that decrease gradually, and each of the steps is formed in a tapered shape to be thinner toward the extending end.

30. A flat panel display apparatus according to claim 29, wherein the first spacers stand on the first surface of the grid between the apertures, and the second spacers stand on the second surface of the grid between the apertures and are aligned with the first spacers.

31. A flat panel display apparatus according to claim 29, wherein the grid has a plurality of spacer holes formed between the apertures and each having a diameter smaller than those of ends of the first and second spacers on grid sides, and the first spacers stand on the first surface of the grid to overlap the spacer holes, and the second spacers stand on the second surface of the grid to overlap the spacer holes and are integrally connected to the first spacers through the spacer holes.

32. A flat panel display apparatus according to claim 29, wherein a height of each of the first spacers is larger than that of each of the second spacers.

33. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates;

a spacer assembly including a plate-like grid which has first and second surfaces and a number of apertures opposing the phosphor exciting sources and which is arranged between the first and second substrates, and a plurality of columnar first spacers standing on the first surface of the grid to be integral therewith and in contact with the first substrate; and a plurality of columnar second spacers standing on the second substrate to be integral therewith and in contact with the second surface of the grid, wherein each of the first and second spacers integrally has a plurality of steps stacked toward an extending end and with diameters that decrease gradually, and each of the steps is formed in a tapered shape to be thinner toward the extending end.

34. A method of manufacturing a spacer assembly having a substrate and a plurality of columnar spacers formed on the substrate and used in a flat panel display apparatus, the method comprising:

preparing a substrate and a plate-like mold having a plurality of stepped tapered through holes each with a diameter that decreases gradually from one end toward the other end thereof;

arranging the mold on a surface of the substrate to be in tight contact therewith such that large-diameter sides of the through holes are located on a substrate side and filling the through holes of the mold with a spacer forming material;

curing the spacer forming material by irradiation with radiation, thereby increasing adhesion of the spacer forming material with respect to the surface of the substrate to be higher than that of the spacer forming material with respect to the mold;

calcining the spacer forming material with the mold being in tight contact with the substrate, thereby integrally forming spacers on the substrate; and after cooling, releasing the mold from the substrate.

35. A method of manufacturing a spacer assembly according to claim 34, wherein a metal substrate covered with an oxide film is used as the substrate.

36. A method of manufacturing a spacer assembly according to claim 34, wherein the mold is subjected to surface treatment which imparts releasability with respect to the spacer forming material and oxidation resistance.

37. A method of manufacturing a spacer assembly according to claim 34, wherein a glass paste containing at least an ultraviolet-curing binder and a glass filler is used as the spacer forming material, and the spacer forming material is cured by irradiation with ultraviolet rays as the radiation.

38. A method of manufacturing a spacer assembly having a plate-like grid with a number of apertures and a plurality of columnar spacers formed on the grid and used in a flat panel display apparatus, the method comprising:

preparing a plate-like grid with first and second surfaces and a plurality of spacer holes located between the apertures;

preparing plate-like first and second molds having a plurality of stepped tapered through holes each having a diameter that decreases gradually from one end toward the other end thereof;

bringing the first and second molds into tight contact with the first and second surfaces of the grid such that large-diameter sides of the through holes are located on a grid side and arranging the first and second molds such that the spacer holes of the grid and the through holes of the first and second molds are aligned, and filling the through holes of the first and second molds with a spacer forming material;

curing the spacer forming material by irradiation with radiation, thereby increasing adhesion of the spacer forming material with respect to the grid to be higher than that of the spacer forming material with respect to the first and second molds;

calcining the spacer forming material with the first and second molds being in tight contact with the grid, thereby forming spacers on the first and second surfaces of the grid; and after cooling, releasing the first and second molds from the grid.

39. A method of manufacturing a spacer assembly according to claim 38, wherein a grid formed of a metal plate having a surface formed with an oxide film is used as the grid.

40. A flat panel display apparatus comprising:

a face plate and a rear plate arranged to oppose each other at a predetermined gap; and a spacer assembly arranged between the face plate and the rear plate, wherein the spacer assembly includes an electrode plate having opposing first and second surfaces and a plurality of spacer holes and arranged between the face plate and the rear plate to oppose the face plate and the rear plate, a plurality of first spacers formed on the first surface of the electrode plate, a plurality of second spacers formed on the second surface of the electrode plate, and connecting portions connecting one of the second spacers to a plurality of the first spacers to each other through corresponding spacer holes formed in the electrode plate.

41. A flat panel display apparatus according to claim 40, wherein each of the spacer holes has a size smaller than that of those ends of the first spacers on an electrode plate side.

42. A flat panel display apparatus according to claim 40, wherein the rear plate includes a plurality of electron-emitting portions, and the electrode plate has a plurality of apertures formed to correspond to the electron-emitting portions.

43. A flat panel display apparatus according to claim 40, wherein the second spacers have an aspect ratio smaller than that of the first spacers.

44. A flat panel display apparatus according to claim 43, wherein a height of each of the second spacers is not more than half that of each of the first spacers.

45. A flat panel display apparatus comprising:

a face plate having an inner surface formed with a phosphor layer;

a rear plate arranged to oppose the face plate at a predetermined gap and provided with a plurality of electron-emitting portions for exciting the phosphor layer;

a frame-like side wall that joins peripheries of the face plate and the rear plate; and a spacer assembly arranged between the face plate and the rear plate, wherein the spacer assembly includes an electrode plate having opposing first and second surfaces and a plurality of spacer holes and arranged between the face plate and the rear plate to oppose the face plate and the rear plate, a plurality of first spacers formed on the first surface of the electrode plate and in contact with the face plate, and a plurality of second spacers formed on the second surface of the electrode plate and in contact with the rear plate, and a plurality of the first spacers are connected to one of the second spacers, by connecting portions, through corresponding spacer holes formed in the electrode plate.

46. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates;

a plate-like grid arranged between the first and second substrates to oppose the substrates and having a first surface opposing the first substrate, a second surface opposing the second substrate, and a number of apertures located to correspond to the phosphor exciting sources;

a plurality of columnar first spacers arranged between the grid and the first substrate and standing on the first surface of the grid to be integral therewith; and a plurality of columnar second spacers arranged between the grid and the second substrate and standing on the second surface of the grid to be integral therewith, wherein a height of each of the first spacers is larger than that of each of the second spacers.

47. A flat panel display apparatus according to claim 46, wherein the grid has a plurality of spacer holes formed between the apertures, each of the spacer holes having a diameter smaller than those of grid-side ends of the first and second spacers, and the first and second spacers are aligned with one of the spacer holes and are integrally formed with each other through the spacer holes.

48. A flat panel display apparatus comprising:

a first substrate having an inner surface with a phosphor layer formed thereon;

a second substrate arranged to oppose the first substrate at a predetermined gap and provided with phosphor exciting sources configured to excite the phosphor layer;

a frame-like side wall that joins peripheries of the first and second substrates;

a plate-like grid arranged between the first and second substrates to oppose the substrates and having a number of apertures located to correspond to the phosphor exciting sources;

a plurality of columnar first spacers arranged between the grid and the first substrate and standing on the first surface of the grid to be integral therewith; and a plurality of columnar second spacers arranged between the grid and the second substrate and standing on the second substrate of the grid to be integral therewith, wherein a height of each of the first spacers is larger than that of each of the second spacers.

* * * * *